US006484545B1

(12) United States Patent
Peter et al.

(10) Patent No.: US 6,484,545 B1
(45) Date of Patent: Nov. 26, 2002

(54) MECHANICAL CODE COMPARATOR

(75) Inventors: Frank J. Peter, Albuquerque, NM (US); Larry J. Dalton, Bernalillo, NM (US); David W. Plummer, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/294,782

(22) Filed: Apr. 19, 1999

(51) Int. Cl.[7] ..... E05B 37/16

(52) U.S. Cl. ..... 70/288; 70/299; 70/306; 70/313

(58) Field of Search ..... 70/278.1, 278.5, 70/278.6, 278.7, 287, 288, DIG. 9, DIG. 21, DIG. 25, 297–299, 304–306, 308, 313

(56) References Cited

U.S. PATENT DOCUMENTS

| | | | | | |
|---|---|---|---|---|---|
| 543,404 | A | * | 7/1895 | Root | 70/313 |
| 599,565 | A | * | 2/1898 | Kintner | 70/313 |
| 1,353,257 | A | * | 9/1920 | Mample | 70/313 |
| 1,483,993 | A | * | 2/1924 | Sprowles et al. | 70/313 |
| 3,009,346 | A | * | 11/1961 | Check | 70/214 |
| 3,126,218 | A | * | 3/1964 | Andrews | 70/432 |
| 3,357,216 | A | * | 12/1967 | Cook | 70/313 |
| 3,722,238 | A | * | 3/1973 | Ring | 70/313 X |
| 4,014,193 | A | * | 3/1977 | Carter | 70/312 X |
| 4,027,508 | A | * | 6/1977 | McGourty | 70/313 X |
| 4,476,698 | A | * | 10/1984 | Treslo | 70/312 X |
| 4,637,235 | A | * | 1/1987 | Conner | 70/DIG. 51 X |
| 4,787,224 | A | * | 11/1988 | Mesa | 70/313 |
| 5,689,983 | A | * | 11/1997 | McCoolidge | 70/252 |

FOREIGN PATENT DOCUMENTS

| | | | | |
|---|---|---|---|---|
| DE | 352885 | * | 5/1922 | 70/313 |
| DE | 1174205 | * | 7/1964 | 70/313 |
| DK | 35246 | * | 11/1925 | 70/313 |
| FR | 618264 | * | 3/1927 | 70/313 |
| FR | 952118 | * | 11/1949 | 70/313 |

* cited by examiner

*Primary Examiner*—Lloyd A. Gall
(74) *Attorney, Agent, or Firm*—Kevin W. Bieg; Brian W. Dodson

(57) ABSTRACT

A new class of mechanical code comparators is described which have broad potential for application in safety, surety, and security applications. These devices can be implemented as micro-scale electromechanical systems that isolate a secure or otherwise controlled device until an access code is entered. This access code is converted into a series of mechanical inputs to the mechanical code comparator, which compares the access code to a pre-input combination, entered previously into the mechanical code comparator by an operator at the system security control point. These devices provide extremely high levels of robust security. Being totally mechanical in operation, an access control system properly based on such devices cannot be circumvented by software attack alone.

8 Claims, 20 Drawing Sheets

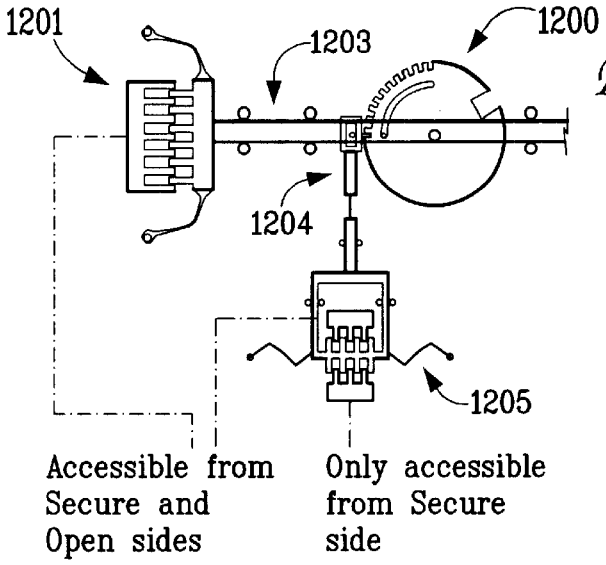
FIG. 12A
FIG. 12B
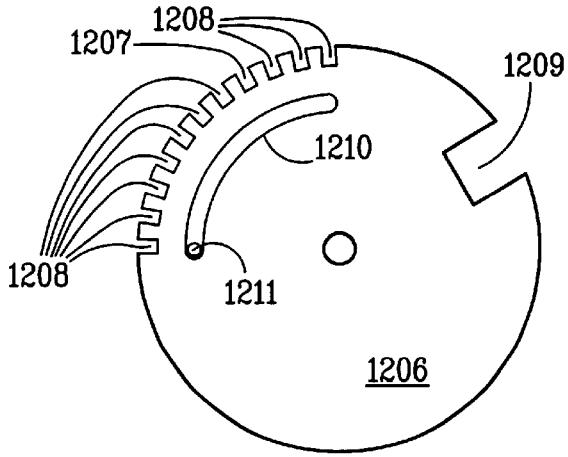
FIG. 12C
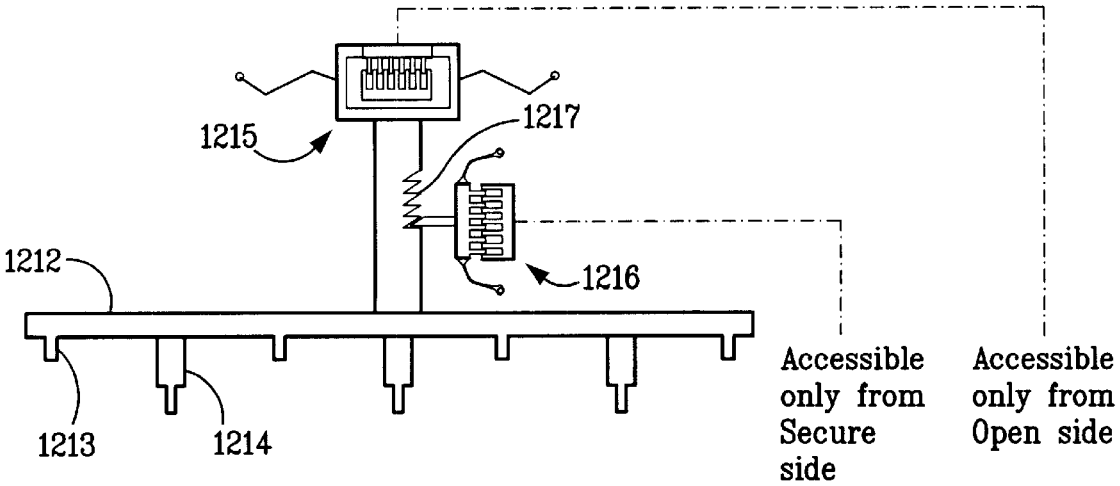

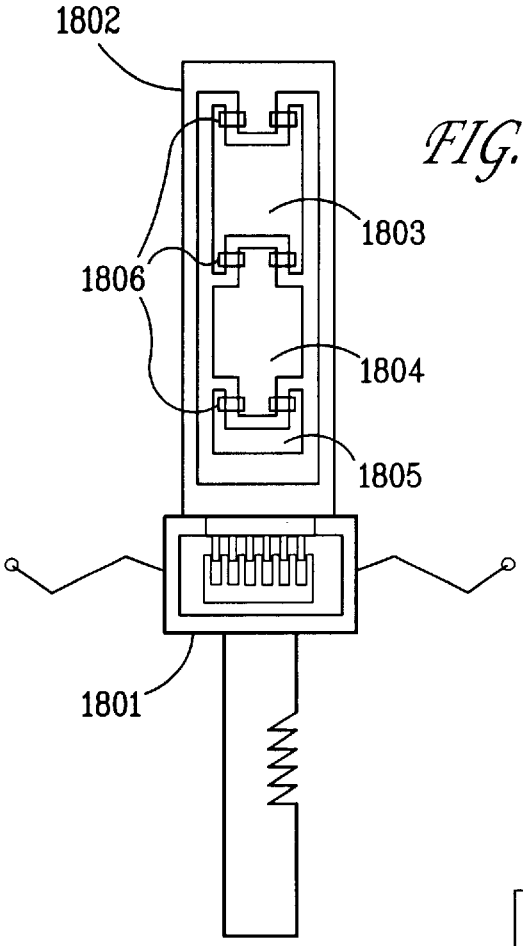
FIG. 18A
FIG. 18B
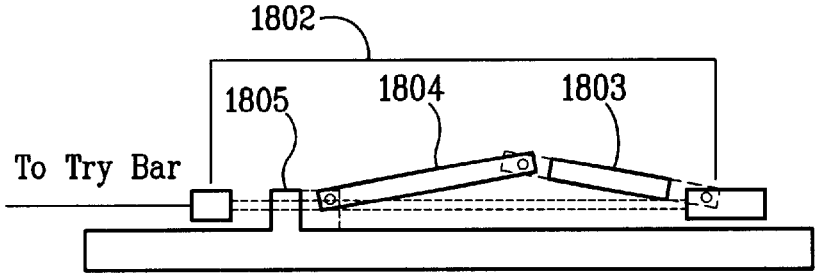
FIG. 18C
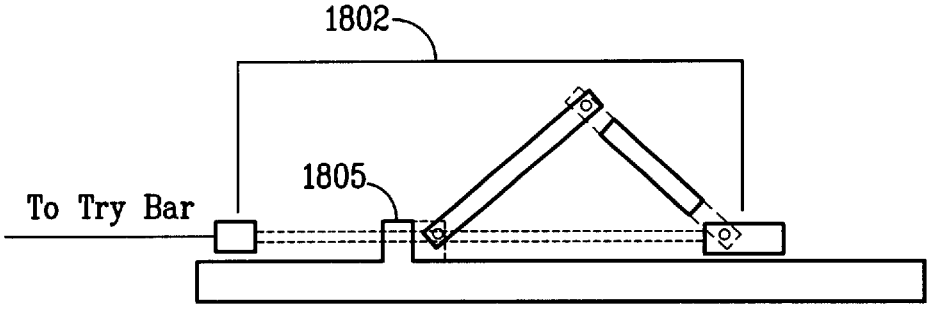

MECHANICAL CODE COMPARATOR

This invention was made with Government support under Contract DE-AC04-94DP85000 awarded by the U.S. Department of Energy. The Government has certain rights in the invention.

BACKGROUND

In historical times, the primary means of controlling access to valuables or information was physical isolation. Such isolation was a side-effect of the need for the rich and powerful to protect themselves against opposing forces in society, and was typically enforced by some combination of locked vaults, secret rooms, inaccessible buildings, and personal guards. This is similar in concept to Fort Knox—dig a large hole, put a huge vault in it, and assign an army to prevent access. In such situations, it is extremely difficult for anyone not otherwise approved for access to threaten the protected assets.

There have evolved categories of valuable assets which cannot always receive appropriate protection using the traditional technique of exclusion. Many technological assets are not particularly valuable unless they are used in a semi-public or public setting. Some assets are so important that, in addition to physical security, simple use of the asset after gaining physical possession must be authorized by a second party. An example might be the portable computer of a top executive, whose company might lose enormous sums of money if the information within could be accessed easily given only physical possession of the equipment. Typical means of control in this type of situation include passwords to penetrate firewalls, encryption of data files, and hidden means of rendering the unit inoperable, such as a device to prevent communication from the keyboard to the main computer.

Other assets gain their value by providing a service to a more-or-less general populace. A common example is the automatic teller machines which are currently taking over many of the functions of a physical banking establishment. Security for such machines exists on several levels, the most obvious being their construction as a rather strong vault. Access by the general public requires a scannable identification card and a simple password. Such a poor level of security is often bypassed, and is found acceptable only owing to limits placed on fund withdrawal and the societal structures which reimburse victims of credit card or bank theft from major loss.

More importantly, however, is that personnel who maintain and service such machines must have a far greater access to the essential functions of the machine—up to and including the ability to issue as much currency as desired. On-site repair of these machines requires the ability to control all of their physical functions. Such control is supposed to be restricted to situations where a technician and a security guard are both in attendance. Clearly, unauthorized access to these repair functions is most undesirable. However, the usual means of access control for such systems is usually a simple password system, perhaps in combination with an electronic release system activated by a central office. However, since both these means are ultimately expressed in software, it is possible for a skilled perpetrator to break into such systems without great difficulty.

Similar threats exist to a wide variety of computer-based assets. Especially with the advent of the Internet, it has become commonplace for malefactors to break past many layers of computer-based security, even to the extent of acquiring the contents of classified files from government installations. Such feats persist despite the use of complex firewall security means.

One reason that many current techniques for access control are vulnerable to external attack is that their key functionality is implemented as computer software. Even when protected firewalls are implemented with separate computer systems connected by a communication system which can be physically cut off, control of that process is a software function. As a result, flaws in the software system can often be exploited in order to compromise system security.

There seems little question at this point that current approaches toward security and access control for computer-based systems and highly-valuable or dangerous assets are inadequate, with the most amazing security systems being overthrown routinely. The inadequacy of current security and access control is becoming more crucial as e.g., electronic cash systems and net access to private and public database systems expands.

Accordingly, there is a need for a simple, robust, and inexpensive approach toward providing greatly improved security against unauthorized access to protected assets while allowing easy access for authorized users. A further aspect is that some aspect of a new approach toward security should be implemented physically, that is, not as a software program. This would greatly increase the difficulty of breaking into the system through flawed software. An additional aspect is that the new approach should be resistant to physical assault, so that physical destruction of a key component does not lead to unauthorized access. Finally, in order to be adopted for general use, the new approach must be inexpensive to integrate with computer-based systems, and must function rapidly and reliably therein.

SUMMARY

The present invention relates to a new class of mechanical code comparators having broad potential for application in safety, surety, and security applications. These devices can be implemented as micro-scale electro-mechanical systems that isolate a secure or otherwise controlled device until an access code is entered. This access code is converted into a series of mechanical inputs to the mechanical code comparator, which compares the access code to a pre-input combination, entered previously into the mechanical code comparator by an operator at the system security control point. The mechanical code comparator can be designed so that the pre-input combination is lost in the process of comparison with the access code. When this happens, a new combination must be input by the control operator before anyone can access the protected system. In another implementation, the mechanical code comparator can be limited to a single attempt to access the system from the public side.

Being totally mechanical in operation, such mechanical code comparators are impossible to circumvent through software alone. These devices can be designed to function by using simple digital electrical pulses to drive microelectromechanical actuators. These devices can be implemented in micromachined silicon, a material particularly suited because of its large strength and the vast knowledge extant in the art of how to form small silicon-based structures using lithography.

BRIEF DESCRIPTION OF THE ILLUSTRATIONS

Figure 4A:
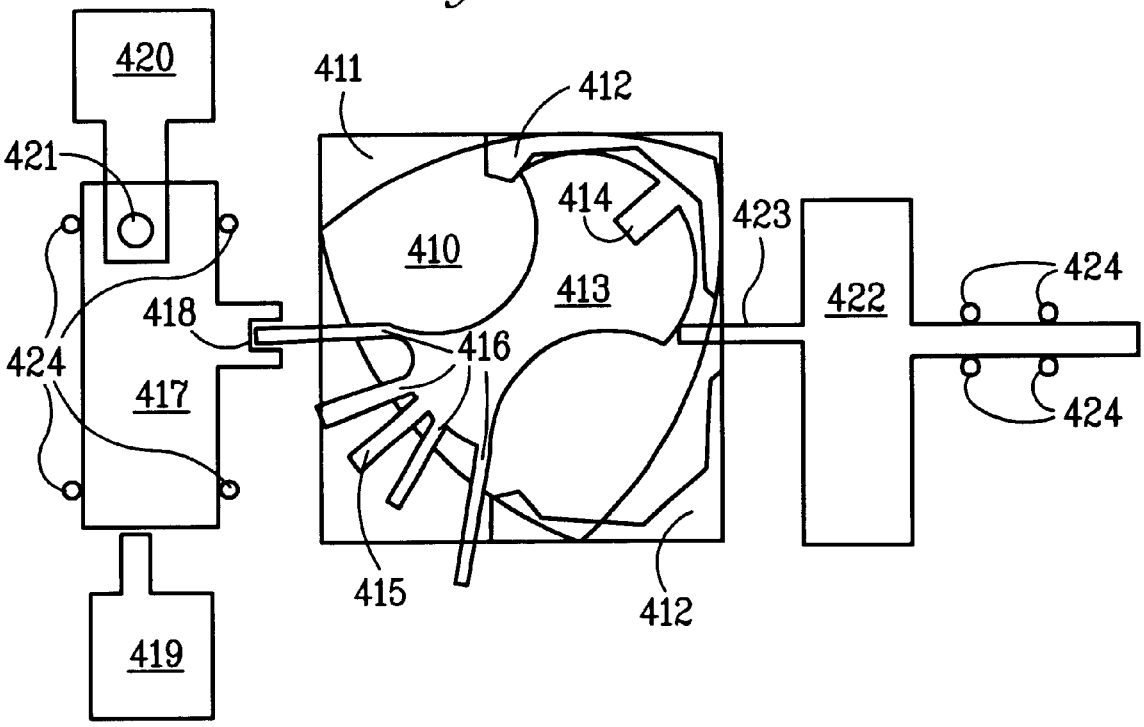
Figure 4B:
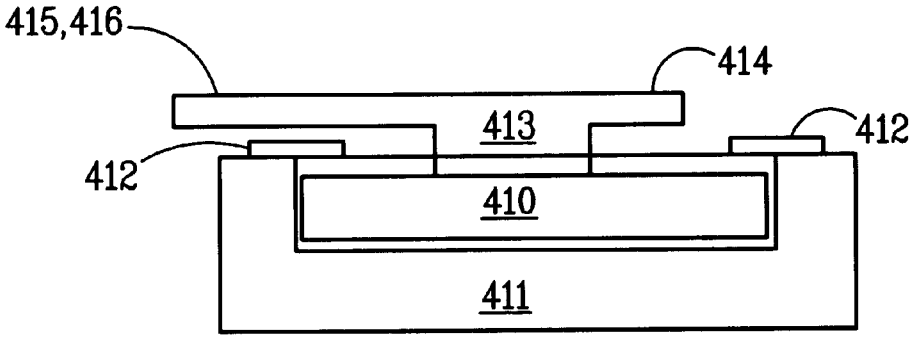

FIG. 4 shows a simplified schematic illustration of a fourth implementation of a mechanical code comparator according to the instant invention. FIG. 4*a* shows a schematic top view of the fourth implementation. FIG. 4*b* shows a schematic cross-sectional view of the fourth implementation.

Figure 5A:
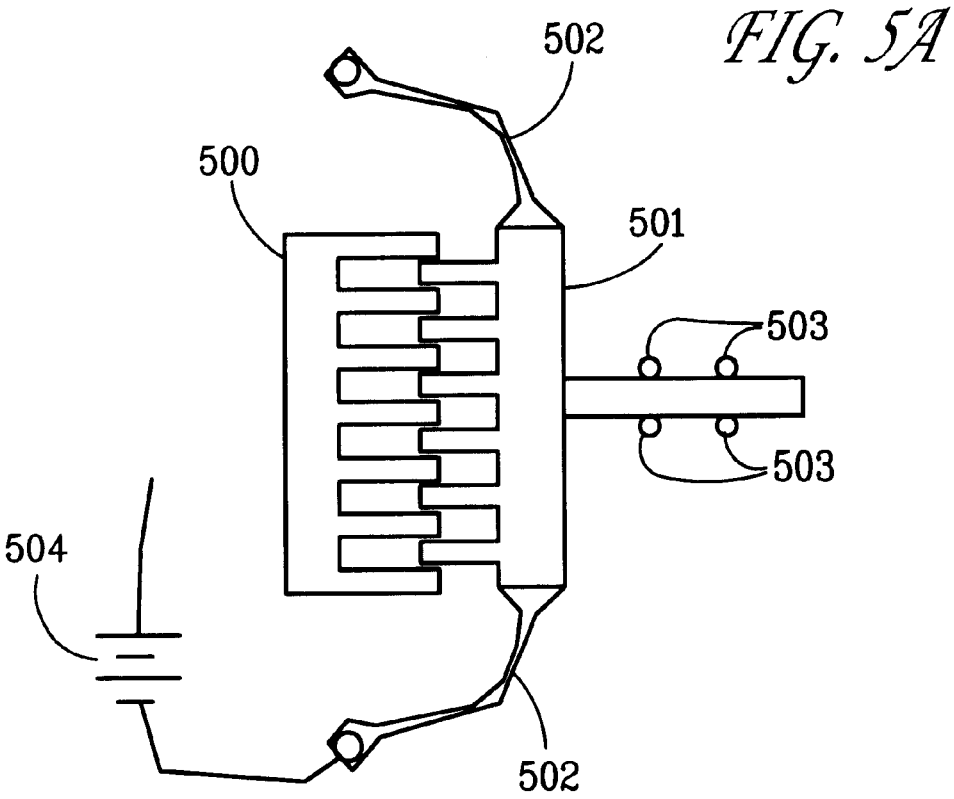
Figure 5B:
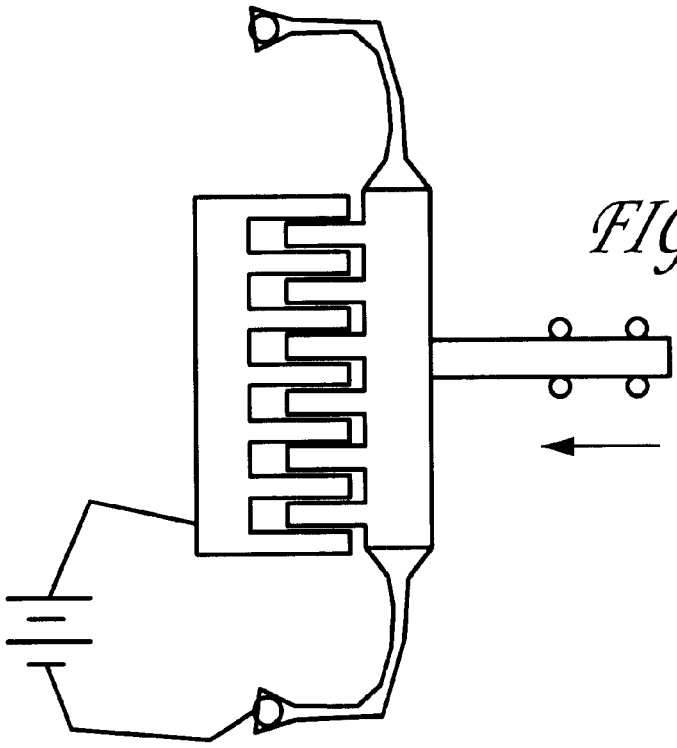

FIG. 5 shows a schematic diagram of a unidirectional electrostatic comb actuator. FIG. 5*a* shows the unidirectional electrostatic comb actuator in the absence of an applied field between the drive comb and the fixed comb. FIG. 5*b* shows the unidirectional electrostatic actuator when an electric potential difference is applied between the fixed drive and the drive comb.

Figure 6A:
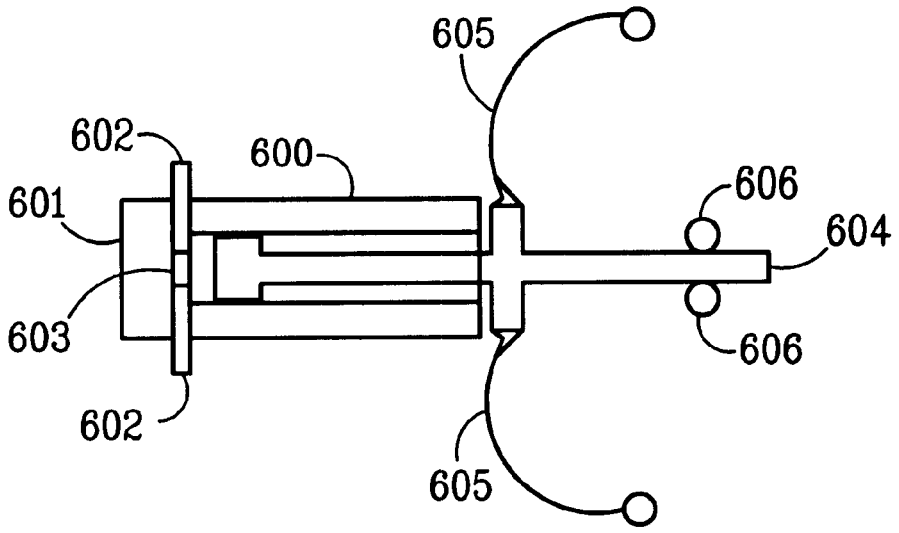
Figure 6B:
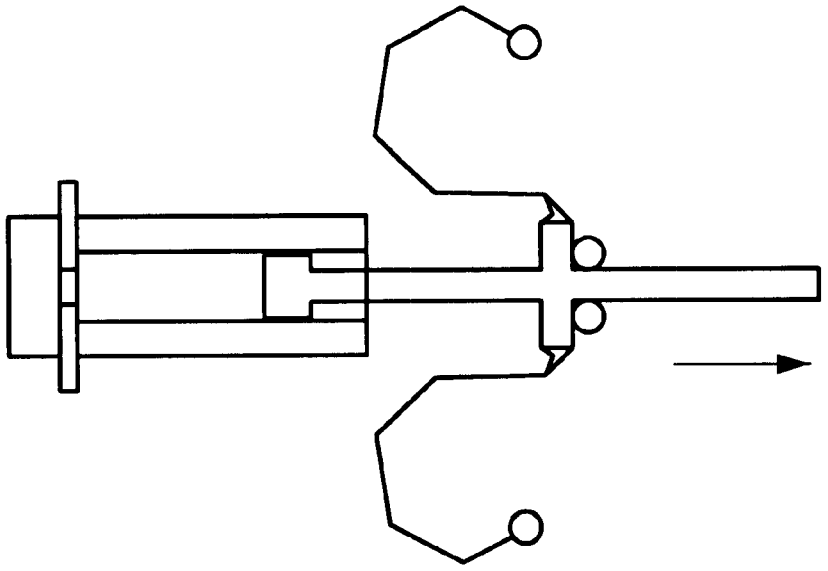

FIG. 6 shows a schematic diagram of a unidirectional steam piston actuator. FIG. 6*a* shows the unidirectional steam piston actuator in the neutral position. FIG. 6*b* shows the unidirectional steam piston actuator in the activated position.

Figure 7A:
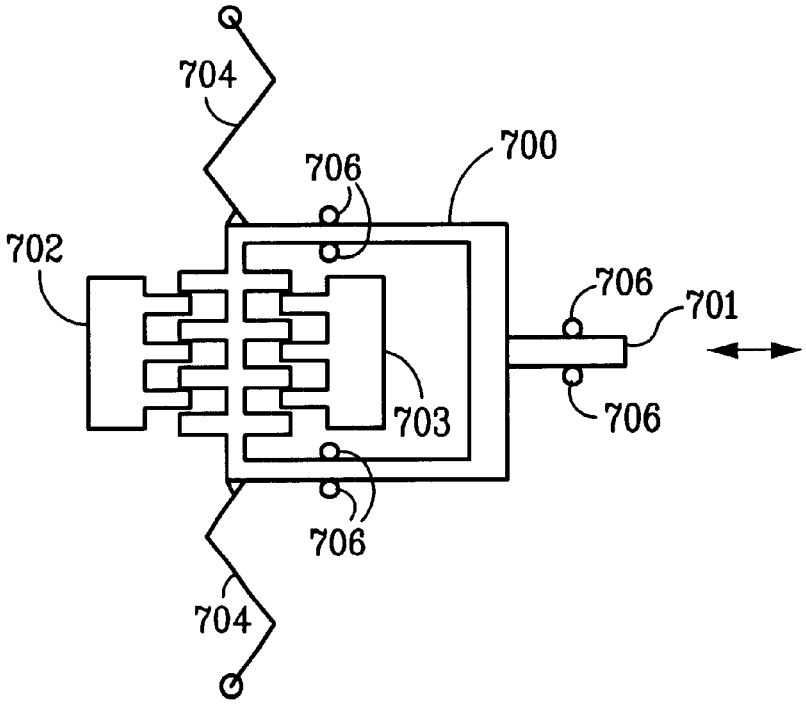
Figure 7B:
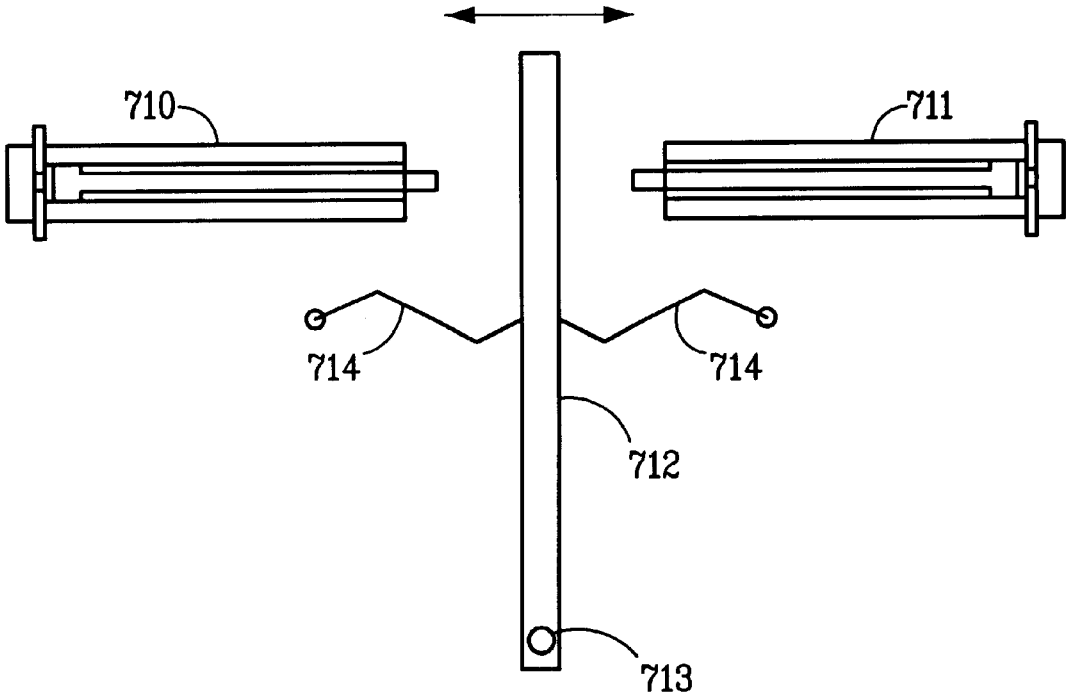

FIG. 7*a* shows a schematic diagram of a bi-directional electrostatic comb actuator, while FIG. 7*b* shows a schematic diagram of a bi-directional steam piston actuator.

FIG. 8 shows a schematic diagram of an implementation of the indexing mechanism for a mechanical code comparator. FIGS. 8*a* through 8*e* show sequential steps during use of the indexing mechanism to rotate the coding element in a clockwise direction.

FIG. 9 shows a schematic diagram of an implementation of the indexing mechanism for a mechanical code comparator. FIGS. 9*a* through 9*e* show sequential steps during use of the indexing mechanism to rotate the coding element in a counterclockwise direction.

FIG. 10 shows a schematic diagram of an implementation of a uni-directional linear indexing mechanism based on an asymmetric rack and pawl movement. FIGS. 10*a* through 10*e* show sequential stages during use of the indexing mechanism.

Figure 11:
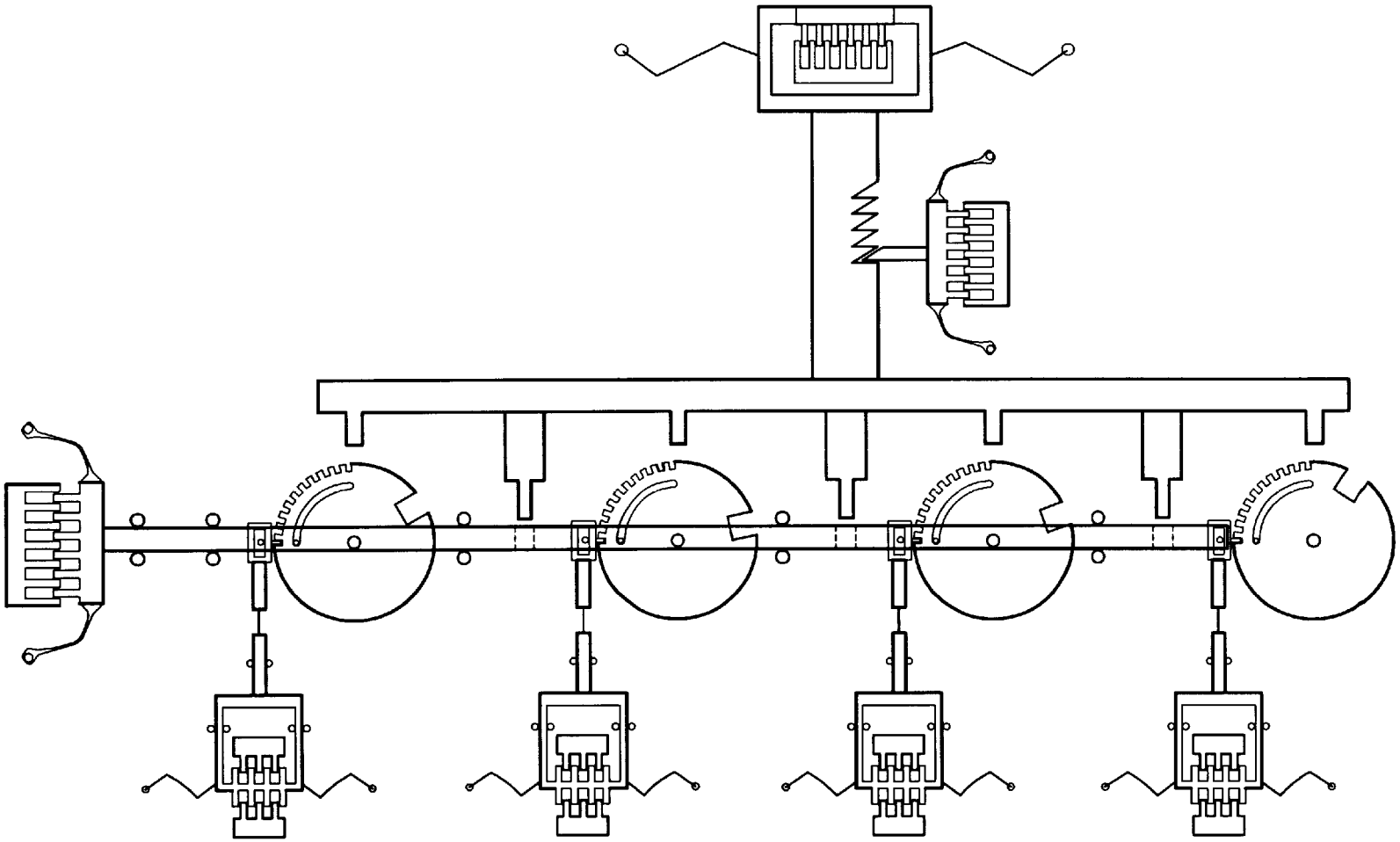

FIG. 11 shows a schematic diagram of a mechanical code comparator having four circular coded elements, a ganged indexing mechanism, and a try bar subsystem comprising a "one-try" mechanism. The comparator is in state of clockwise reset—the coded elements are all in their furthest clockwise position.

FIG. 12 shows detail enlargements of portions of FIG. 11. FIG. 12*a* shows a coded element and its associated indexing mechanism. FIG. 12*b* shows the coded element in more detail. FIG. 12*c* shows the try bar subsystem in detail.

Figure 13:
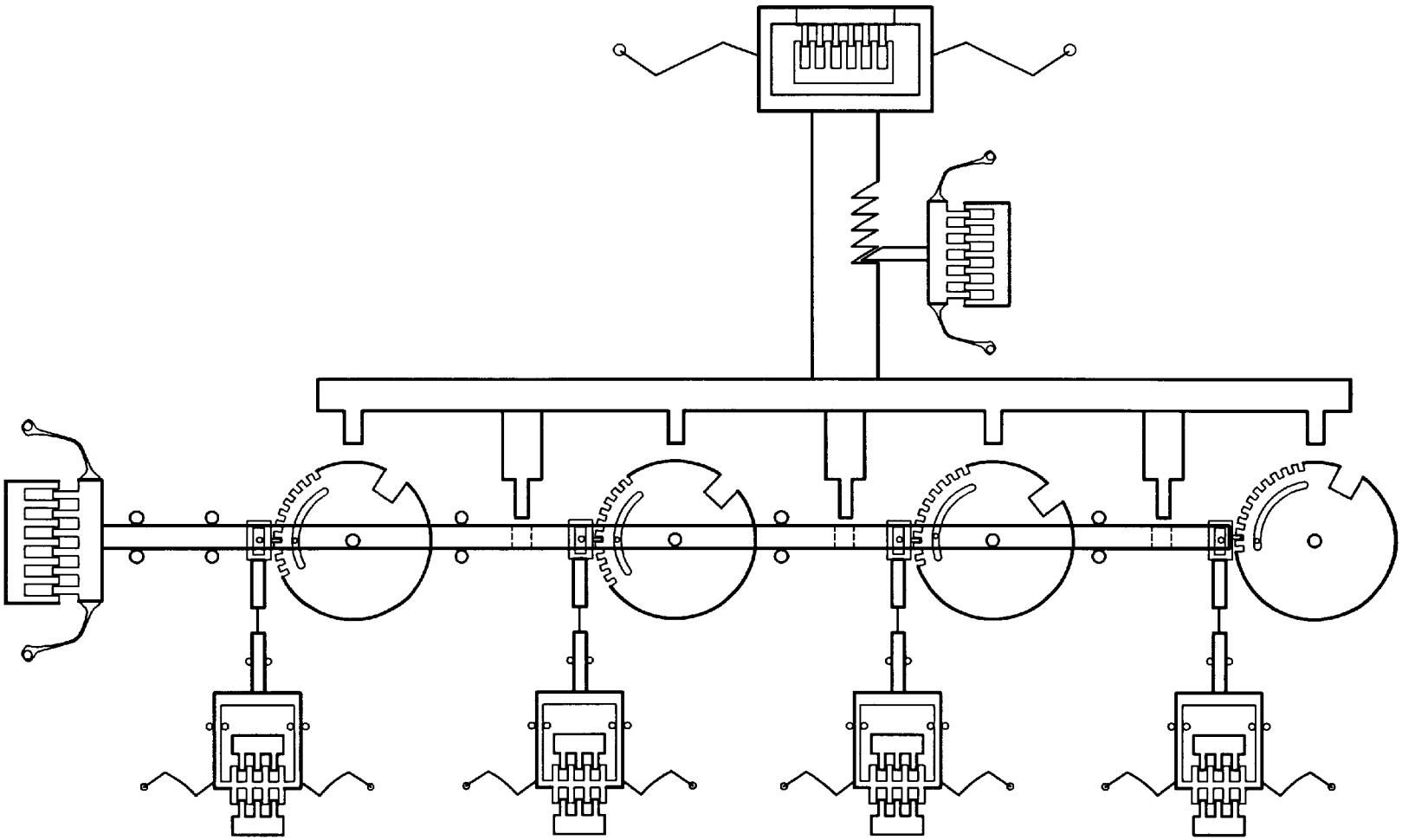

FIG. 13 shows the system of FIG. 11 after a security code has been entered by the access control authority.

Figure 14:
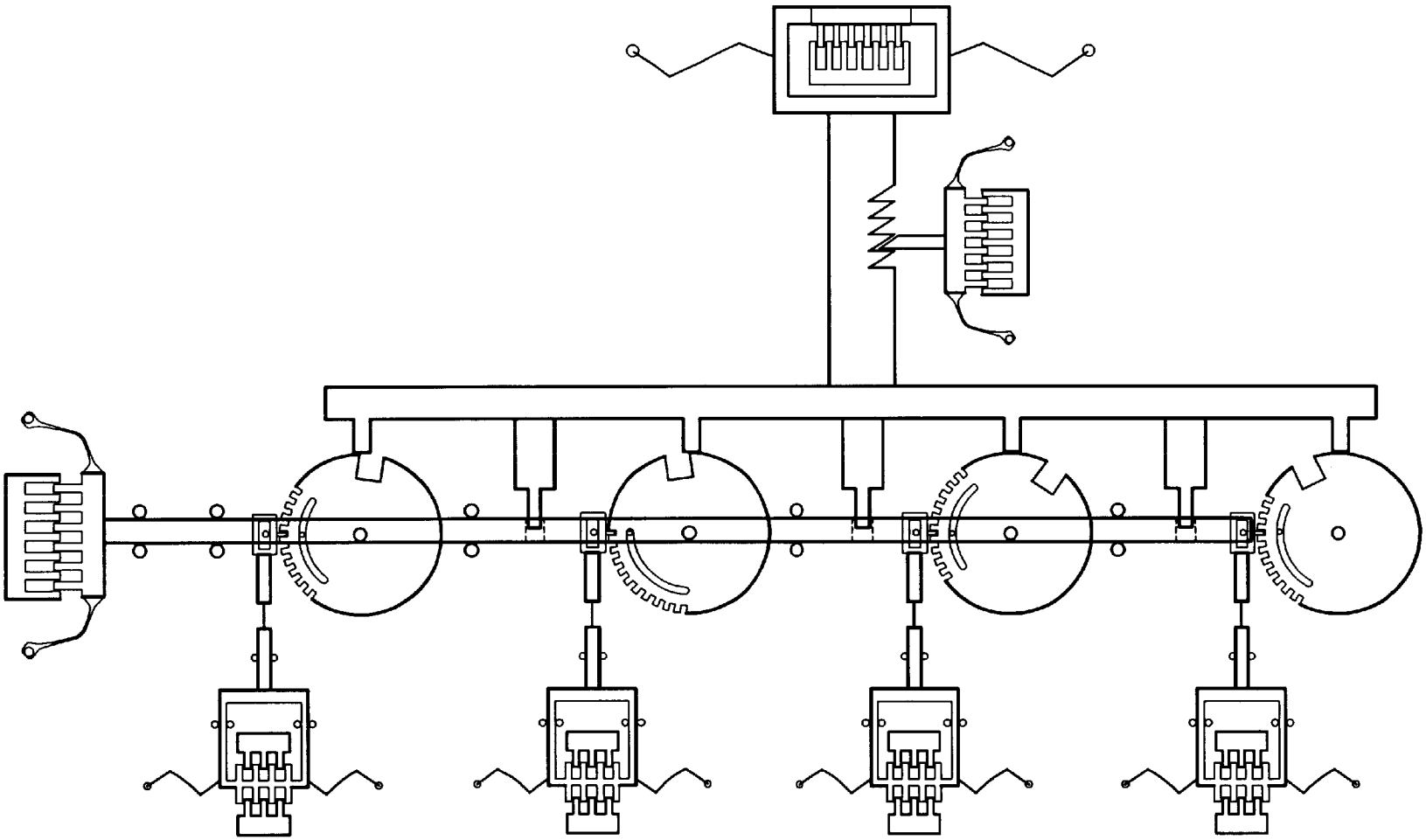

FIG. 14 shows the system of FIG. 13 after an incorrect access code has been entered and an attempt made to move the try bar. The try bar moved only far enough that the "one-try" mechanism engaged, thereby preventing additional attempts to gain access.

Figure 15:
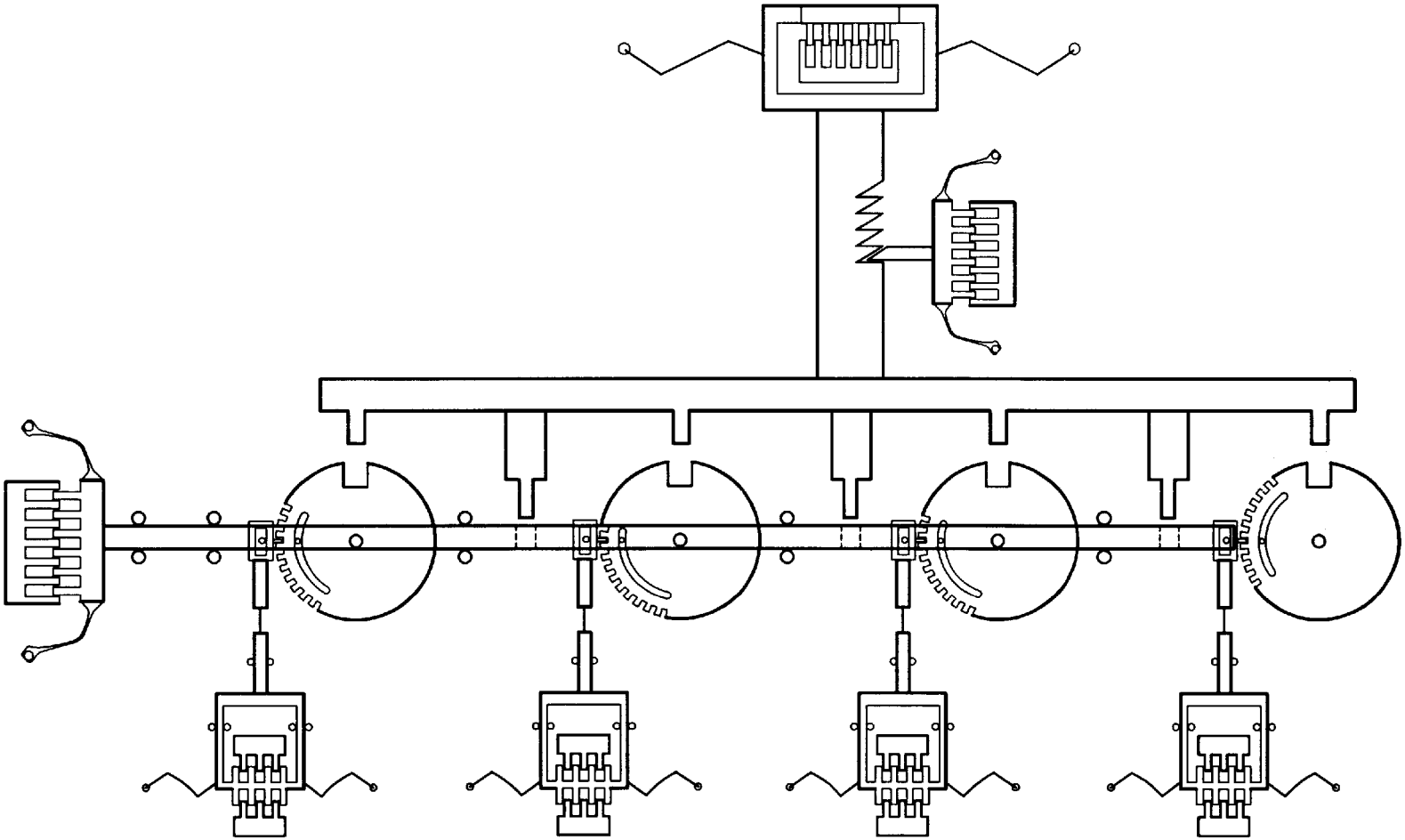

FIG. 15 shows the system of FIG. 13 after a correct access code has been entered. Note that the try bar keys all align with their respective try bar notches, so that the try bar is free to move downward.

Figure 16:
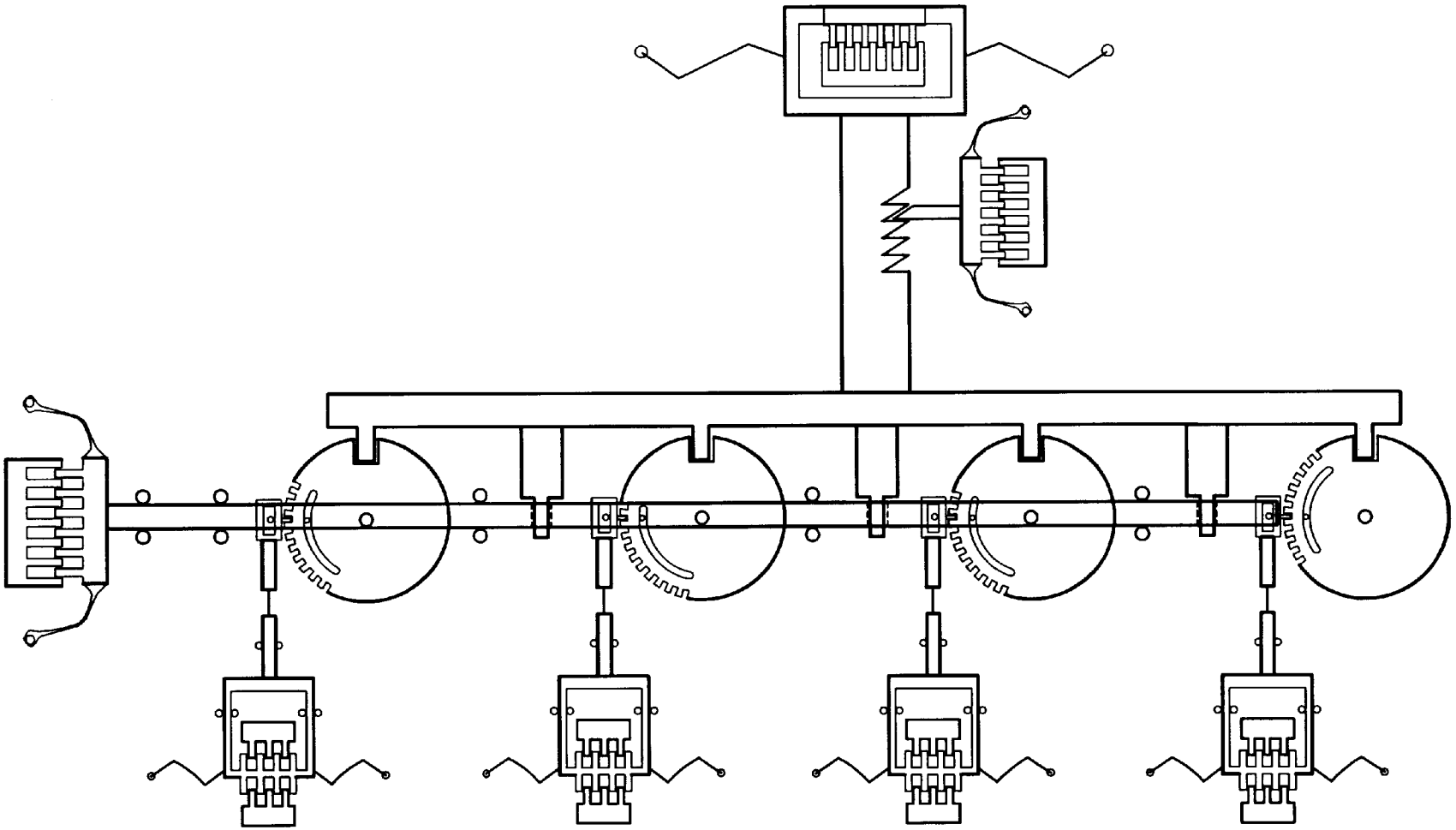

FIG. 16 shows the system of FIG. 15 after the try bar has been moved downward. That motion has activated access to the protected asset (through means not illustrated here). The comparator is now locked in the "access" position by the "one-try" mechanism.

Figure 17A:
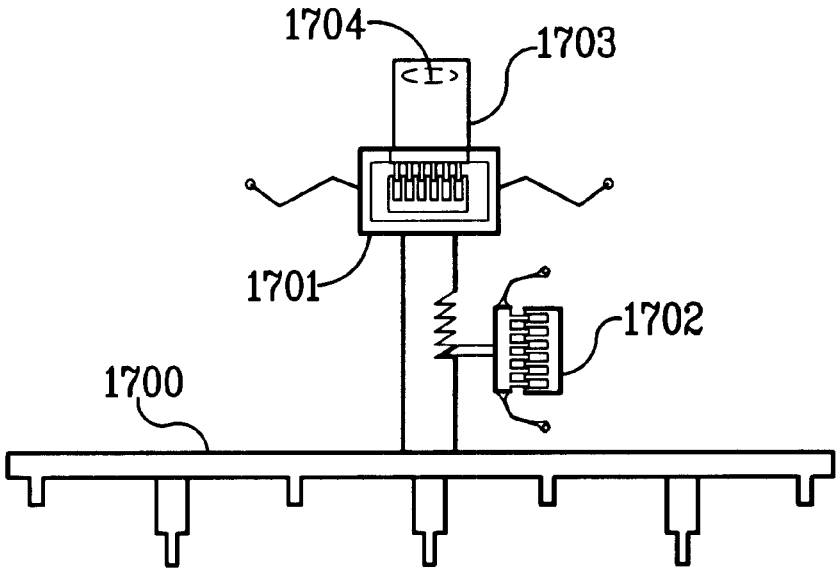
Figure 17B:
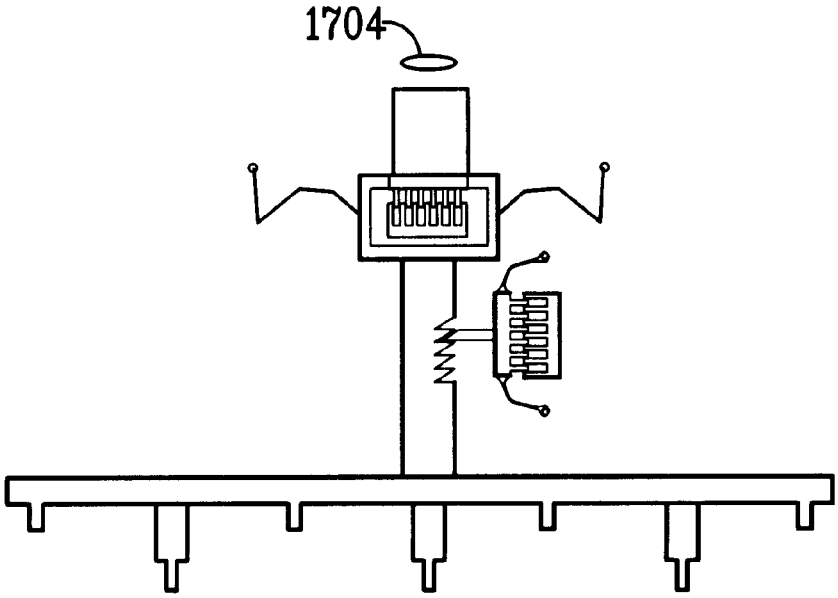

FIG. 17 shows a schematic drawing of an optical switch which is activated by the motion of the try bar mechanism when a correct access code is input to the mechanical code comparator. FIG. 17*a* shows the "access forbidden" position, whereas FIG. 17*b* shows the "access allowed" position.

FIG. 18 shows a schematic drawing of an optical deflection mechanism which is activated by the motion of the try bar mechanism when a correct access code is input to the mechanical code comparator. FIG. 18*a* shows the mechanism as it rests on a surface which also supports the comparator. FIG. 18*b* shows a cross-section of the optical deflection mechanism before the try bar has moved, while FIG. 18*c* shows a similar cross-section after the access code has been entered and the try bar has been moved.

Figure 19A:
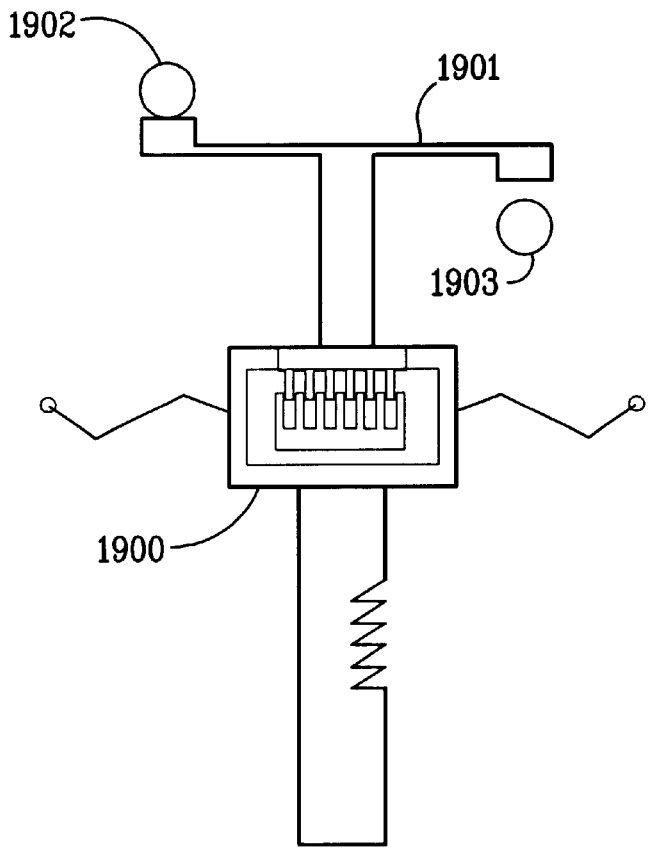
Figure 19B:
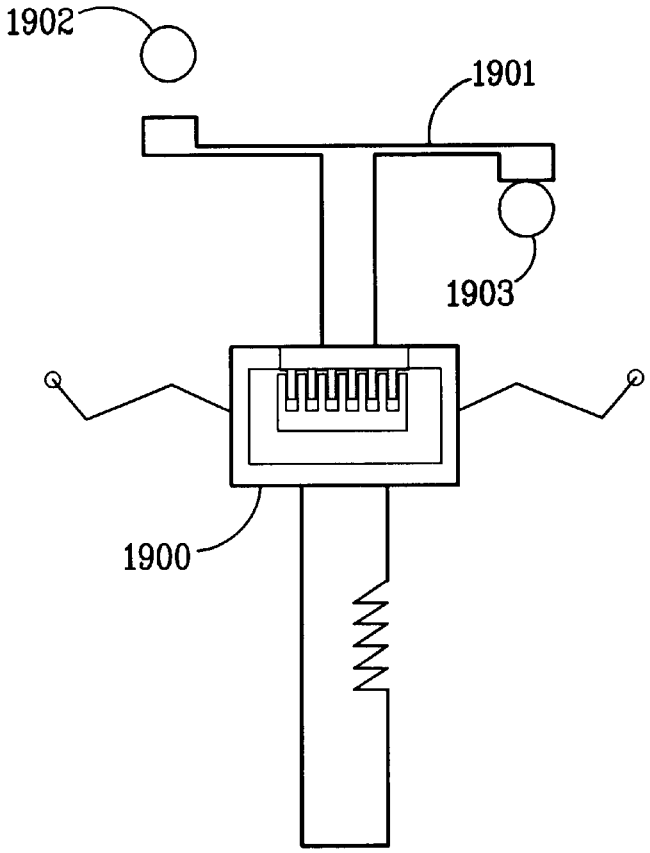

FIG. 19 shows a schematic diagram of an electrical switch which is activated by the motion of the try bar mechanism when a correct access code is input to the mechanical code comparator. This is a single pole-double throw switch. FIG. 19*a* shows the initial position, and FIG. 19*b* the position following entry of the access code and moving the try bar.

Figure 20:
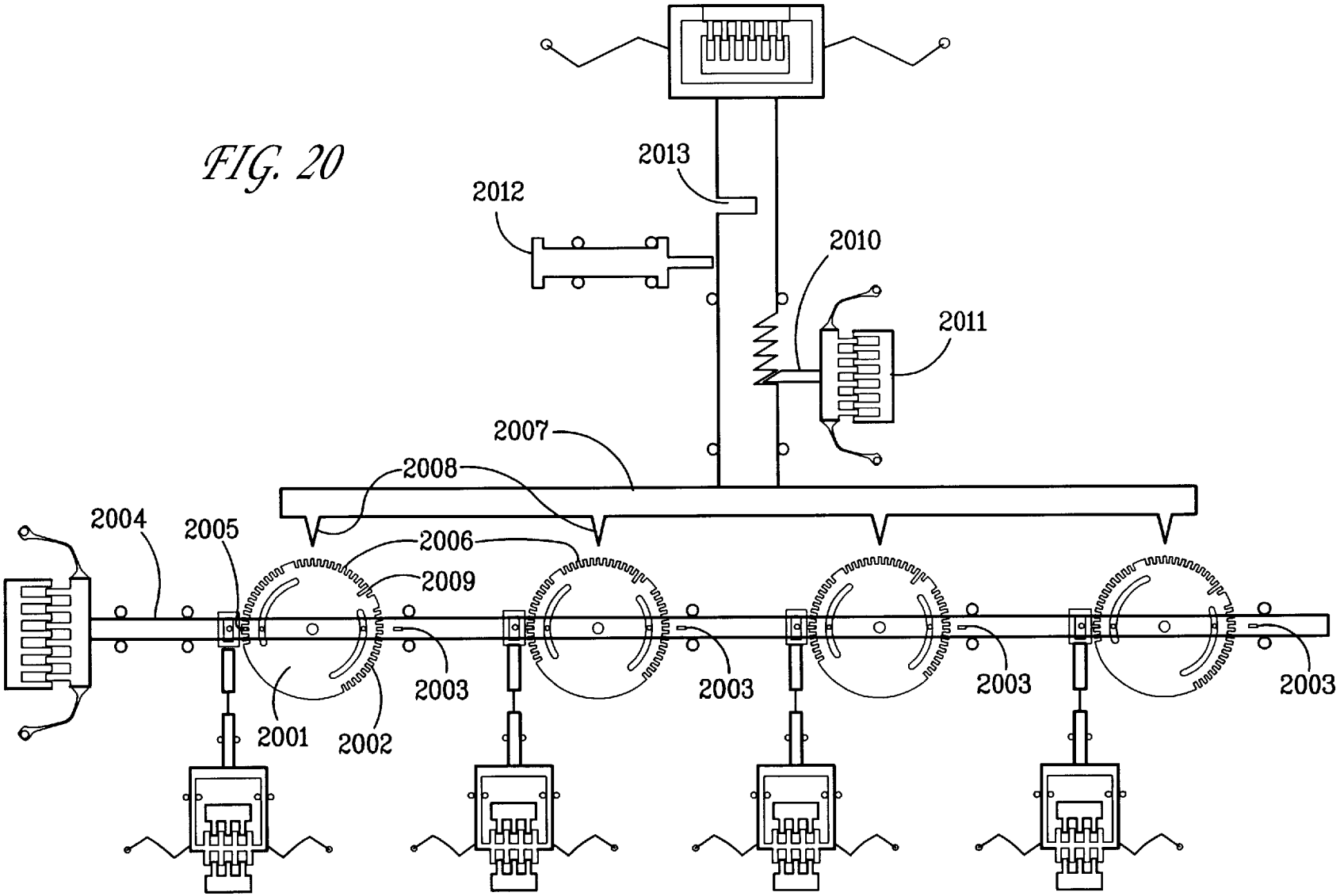

FIG. 20 shows a schematic diagram of another implementation of a mechanical code comparator having four circular coded elements.

DETAILED DESCRIPTION

The needs for an improved approach toward security and access control of valuable assets outlined above are addressed here through the invention and application of a mechanical code comparator, or MecoCOMP. In brief, a MecoCOMP is a mechanical device which compares an access code mechanically input by a potential user with a security code input by an access control authority. Even though the security code is input by, e.g., conventional digital circuitry, no memory of the code need be retained by the system save for the mechanical setting of the MecoCOMP.

If the access code and the security code match, a mechanical action is allowed which activates the security apparatus, thereby allowing access to the system. This action may be to complete an electrical connection, or to open a passage so that a beam of light triggers an optically sensitive detector. A MecoCOMP can be designed so that memory of the security code is destroyed by comparing it to the access code, thus providing only one chance at entering the proper code. After that, the potential user has to get reauthorization from the access control authority, who then can set another security code. Such a unit can also be designed so that only one comparison can be made, after which the MecoCOMP must be reset by the access control authority.

An important feature of the MecoCOMP principle is that, although the physical structure of a MecoCOMP must be robust under operating conditions, it should cease to function rather than allow attempts to mechanically intervene with the proper function of the comparator. In an analogy, if the MecoCOMP were a lock, we prefer that attempts to pick the lock physically break the lock mechanism while leaving it in a locked condition. This consideration, especially when combined with the desire for rapid functioning and sizes compatible with use in, e.g., smart credit cards, suggest the installation of a very small MecoCOMP apparatus inside a container which is difficult to open. This in turn leads to a preferred implementation of MecoCOMP apparatus in, e.g., micromachined silicon and related materials. All specific implementations of the present invention described herein will take this form, but the MecoCOMP apparatus can be implemented in a wide variety of material systems.

A number of implementations of MecoCOMP apparatus, and subsystems thereof, will be outlined below. Discussion of specific implementations is not intended to limit the scope of the present invention, which is limited only by the scope of the claims.

Figure 1:
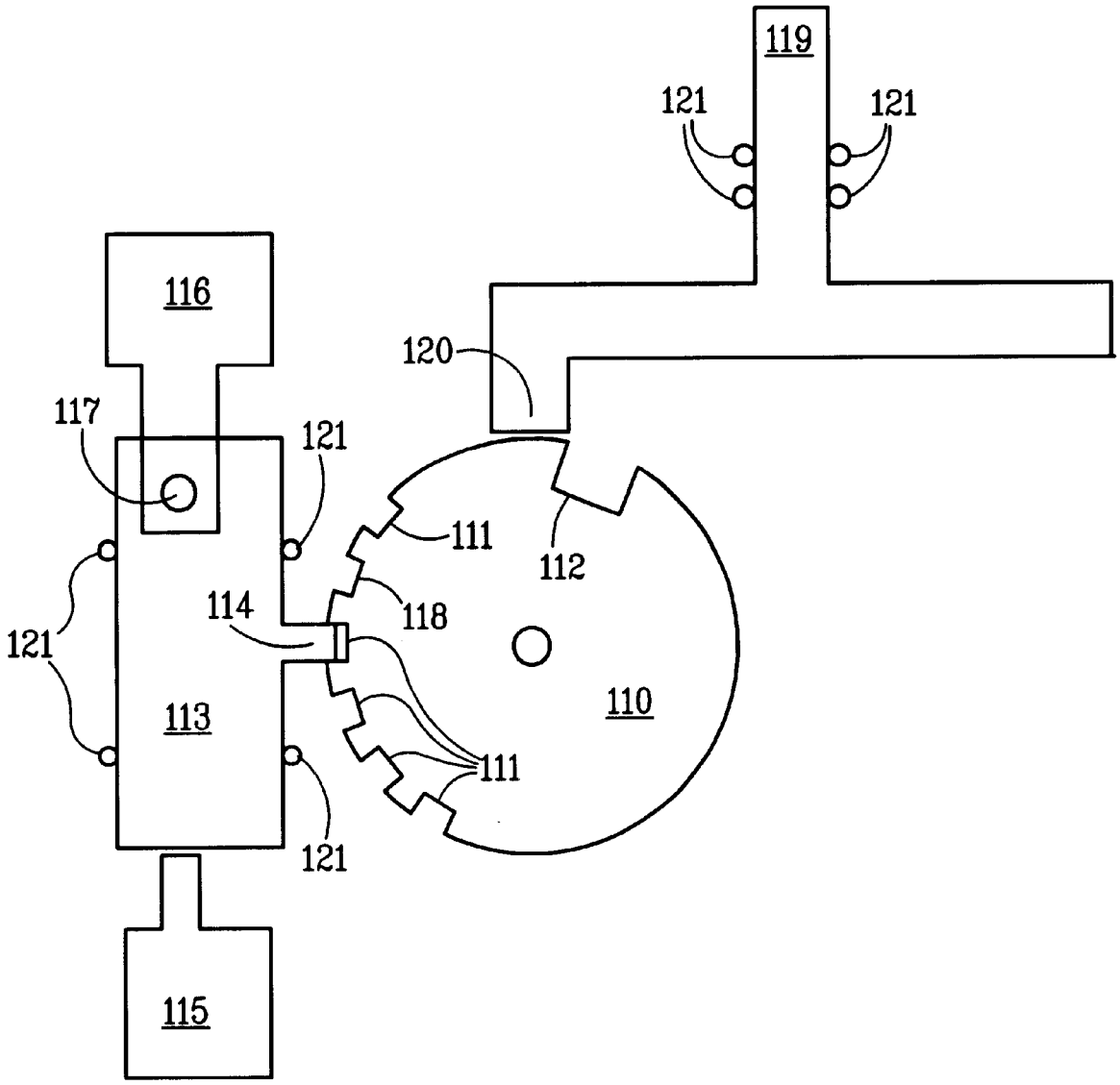
FIG. 1 shows a simplified schematic illustration of a first implementation of a mechanical code comparator according to the instant invention.

FIG. 1 shows a highly schematic implementation of a MecoCOMP device. There is a coded element, which in this case is a wheel 110 rotating on a pivot whereon a plurality of index features are defined by notches 111 and code notch 118. Try bar feature 112 is a notch in the edge of wheel 110 located in a special relationship to code notch 118 which will be described below. Indexing mechanism 113 is a device whose motion is limited to those compatible with its basic function by (symbolic) bearings 121. The action of indexing mechanism 113 is driven by uni-directional actuator 115 and by bi-directional actuator 116, which is attached to the indexing mechanism via pin 117 so that forces in both directions can be transmitted. Details of the indexing mechanism will be discussed later, but the effect of the indexing mechanism is to move indexing tab 114 so as to rotate coded element 110 the distance between two notches and then to reinsert indexing tab 114 into a notch neighboring the notch in which it originally resided. Uni-directional actuator 115 can only drive motion of the coded element 110 in one direction, whereas bi-directional actuator 116 can drive motion in either direction. Try bar 119 is free to slide between bearings 121, and positioned so that try bar key 120 rides on the edge of coded element 110, but slips into try bar feature 112 when indexing tab 114 is located in code notch 118.

In operation, the access control authority (not shown) uses the bi-directional actuator 116 and the indexing mechanism 113 to step the coded element 110 in a clockwise direction so that the most-clockwise notch 111 opposes indexing tab 114. (The direction of motion, of course, is arbitrary.) The authority can then set a security code into the MecoCOMP by again using bi-directional actuator 116 and the indexing mechanism 113 to step the coded element 110 the appropriate number of notches in a counter-clockwise direction.

A potential user now attempts to gain access. First, this user does not have access to the controls (not shown) for the bidirectional actuator 116, but can only access the uni-directional actuator 115. As a result, a user can only make the coded element 110 step in a counter-clockwise direction. Thus, if the user is told that the access code is 2, he uses the controls (not shown) of the uni-directional actuator 115 to drive the indexing mechanism 113 to step the coded element 110 two steps counter-clockwise. When the code is set, a try bar drive (not shown) is activated to attempt to move the try bar key into the try bar feature. If successful, the motion of the try bar 119 activates the desired secure function.

If the attempt to enter the access code was unsuccessful, the access control authority must reset the MecoCOMP and enter a new security code, because the attempt to enter an access code scrambled the security, code setting main a manner not known by the authority. The authority is also free to reset the security code after a period of time, so that the potential user has a window of, e.g., five minutes within which to gain access to the secured assets.

The MecoCOMP as shown has a weakness in that, knowing that the proper access code is some number of counter-clockwise steps, a potential user can gain access by taking a single step, activating the try bar drive, taking a second step, activating the try bar, and so on until the proper setting is encountered. This weakness is obviated in a practical MecoCOMP such as illustrated in FIG. 13, where the mechanism comprises several coded elements and a single try bar having several try bar keys which must interlock with the try bar features of all coded elements simultaneously.

FIG. 1 shows a coded element having only 6 index features. In practice, coded elements having 50–100 index features are feasible. As a result, a multi-coded-element MecoCOMP with 6 wheels could accept one code from as many as $10^{12}$ possible codes. However, an unauthorized user cannot enter more than 600 codes to such a MecoCOMP, because such a user only has access to the uni-directional actuator 115, and can only move the coded elements in a counter-clockwise manner. (We assume here that an attempt to access the system by exhaustion is being made by the unauthorized user, and as a result the access control authority is not resetting the security code between access attempts.) There is less than 1 chance in $10^9$ of accessing the secured asset before the MecoCOMP becomes nonfunctional from the users side. (The exact odds depend on the precise design of the MecoCOMP.) This level of security is considered unspoofable in practice.

Figure 2:
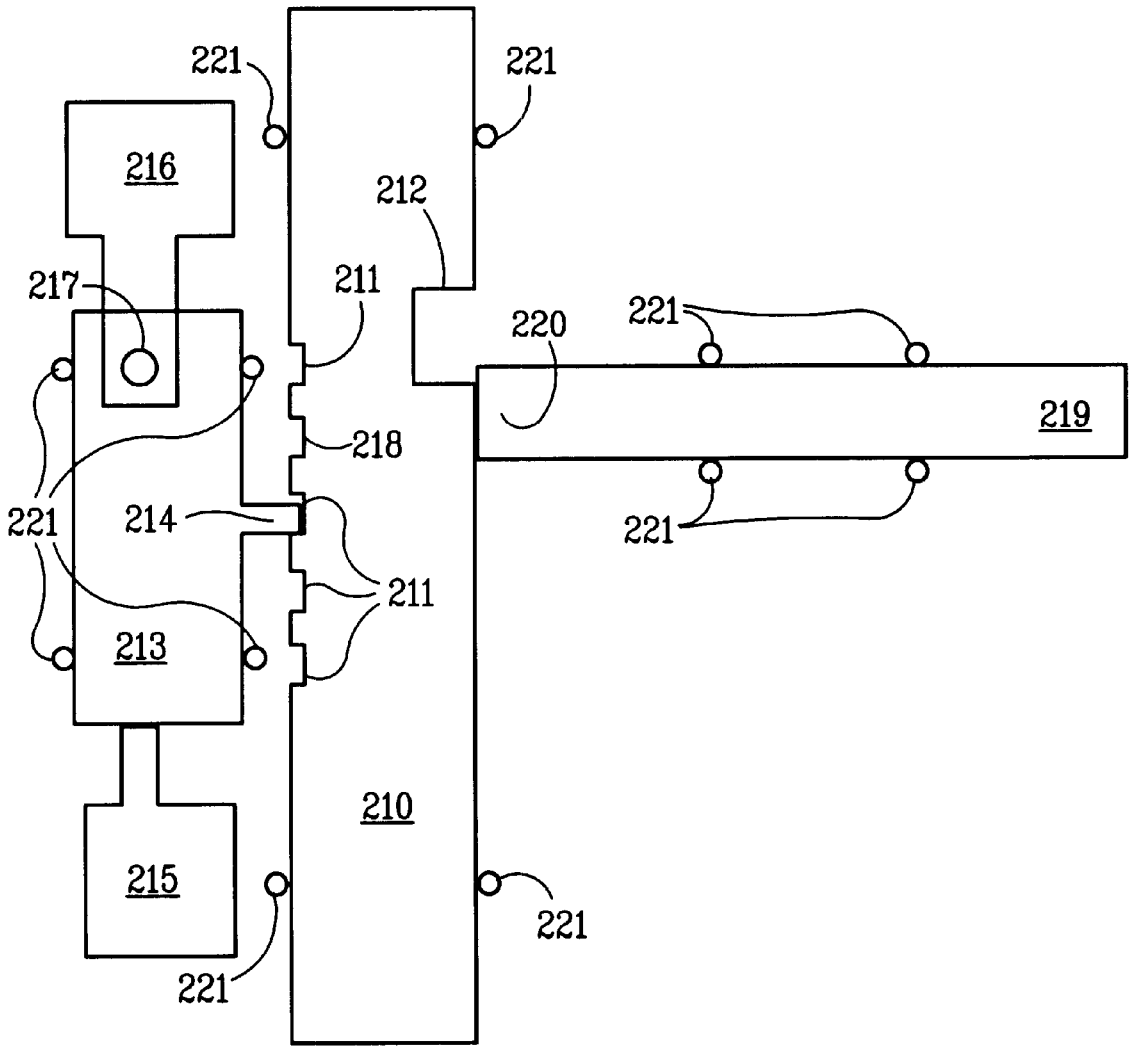
FIG. 2 shows a simplified schematic illustration of a second implementation of a mechanical code comparator according to the instant invention.

It is not necessary for the coded element to take the form of a notched wheel. FIG. 2 shows, at the same level of detail, a MecoCOMP device having a linear coded element 210. The linear coded element 210 is free to slide through bearings 221, which limit it to linear motion. As before, the linear coded element 210 has a plurality of index features taking the form of notches 211 and code notch 218, and a try bar feature 212. The function and nature of indexing mechanism 213, indexing tab 214, uni-directional drive 215, bi-directional drive 216, and pin 217 are the same as their analogous components in FIG. 1—they serve to move the linear coded element 210 toward or away from the top of the figure one step at a time. Again, when indexing tab 214 is aligned with coded notch 218, try bar key 220 is aligned with try bar feature 212, so that the try bar drive (not shown) can move the try bar 219 to the left.

Figure 3:
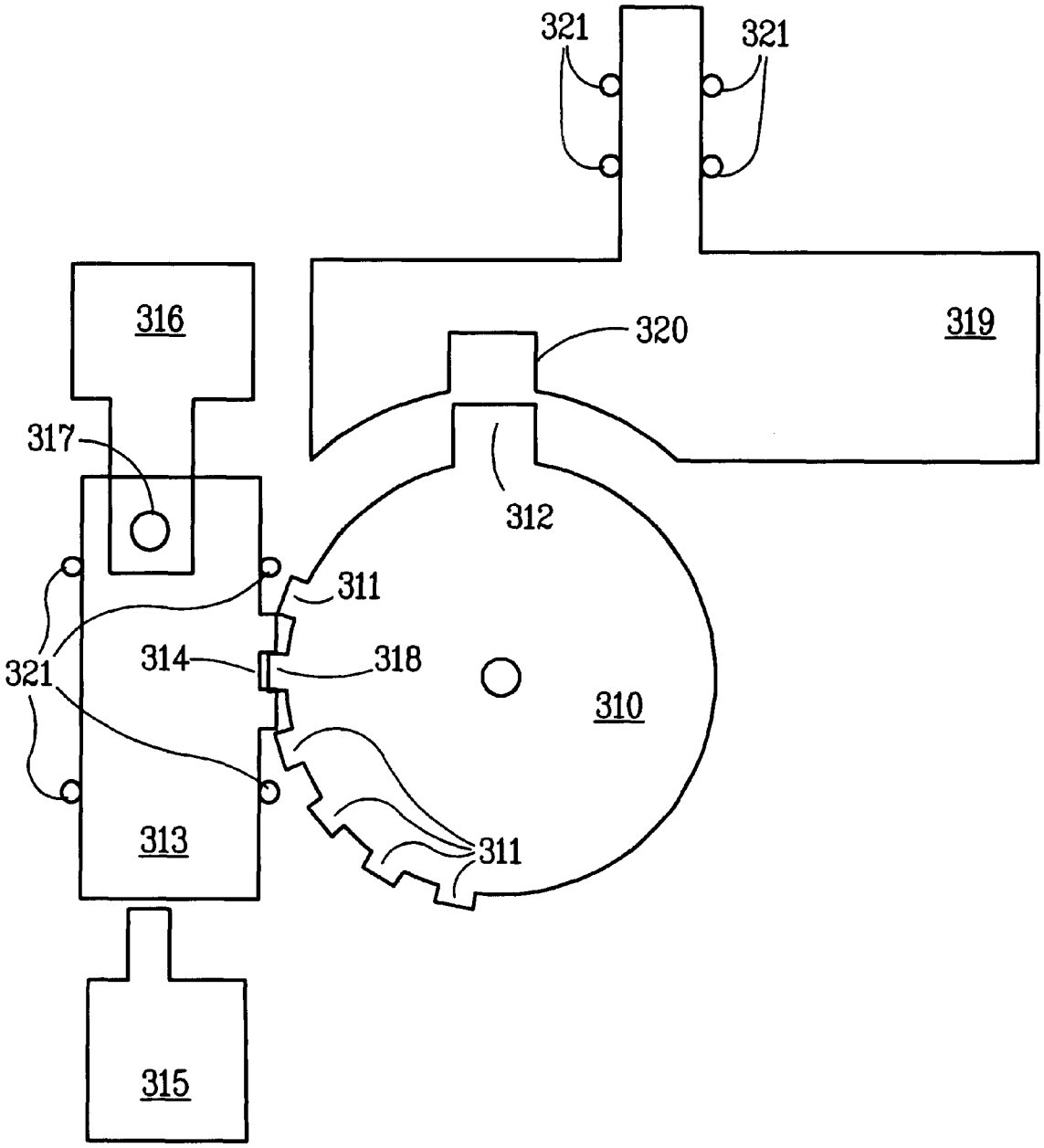
FIG. 3 shows a simplified schematic illustration of a third implementation of a mechanical code comparator according to the instant invention.

Clearly, the principles of operation are the same as illustrated and discussed concerning FIG. 1, being nearly independent of the design details. This point is emphasized by FIG. 3, which shows a MecoCOMP device based on a wheel-like coded element 310, but having tabs 311 and 318 instead of notches 111 and 118, and try bar feature 312 is a tab rather than a notch. Similarly, indexing mechanism 313 and the actuators 315 and 316 function in the same manner, but they use indexing notch 314 to move the coded element, whereas indexing tab 114 is used in FIG. 1. The try bar 319 functions in the same manner as that in FIG. 1, save the try bar key is now a notch 320 instead of the key shown in FIG. 1, and the surface of the key bar 319 near the key bar notch 320 is cylindrical, so that the key bar 319 will not move unless the key bar notch 320 is properly aligned with the try bar feature 312.

An extreme example that obvious symmetries are not needed to make a functional MecoCOMP device appears in FIG. 4. FIG. 4*a* shows a schematic top view, while FIG. 4*b* shows a schematic cross-sectional view. Here, rather than a wheel or a bar, the coded element 410 takes the aspect of a figure of constant width rotating inside a square well 411. Coded element 410 is restricted to rotate in square well 411 by cover plates 412. Element 410 has no rotational axis, so requires a somewhat complex coded structure 413, which rotates with element 410, but has a plurality of index features comprising fingers 416 and coded finger 415, as well as key bar feature 414. The indexing mechanism, actuators, and try bar are essentially the same as those appearing in FIG. 3. Note that coded structure 413 requires a special shape surrounding the key bar feature 414, so that the key bar finger 423 will make contact with this structure at a (nearly) constant horizontal position as the coded element 410 turns.

The general procedure for operation and the basic structure of the various substructures are identical for the MecoCOMP devices shown in FIGS. 1–4. Other variations will be clear to one skilled in the art, and are intended to be included in the scope of the present invention.

Many types of actuator can be used to carry out the function of the uni-directional actuator accessible to the user of the MecoCOMP and that of the bi-directional actuator accessible to the access control authority. A wide variety of hydraulic, electromagnetic, and even direct mechanical actuators can be applied to these purposes. In fact, even though the implementations discussed in detail in this specification involve linear actuators, other implementations involving rotary actuators will be clear to those skilled in the art.

Some discussion of suitable linear actuators for very small MecoCOMP devices seems appropriate. Overall dimensions of a MecoCOMP unit fabricated using micro-electro-mechanical system (MEMS) technology, that is, fabricated directly from a silicon wafer using lithography, will usually be several millimeters or less in size. On this size scale electrostatic motors and actuators become more powerful and more efficient than their electromagnetic cousins, and hence these, or other actuators effective on this size scale, are particularly compatible with use in small MecoCOMP devices.

A great deal of development work on electrostatic actuators exists, and may be applied to the design of MecoCOMP devices. Accordingly, the illustration in FIG. 5 is simply for reference. FIG. 5 shows the essential components of one type of linear electrostatic actuator. Drive comb 501 is positioned so that the comb teeth interdigitate with those of fixed comb 500. The drive comb slides on a supporting surface (not shown) along a linear, path defined by bearings 503. In the absence of an applied field between the drive comb and the fixed comb (FIG. 5*a*), the drive comb is located at a neutral position through the action of springs 502, whose far ends are attached to the supporting surface. When an electric potential difference is applied between the fixed comb and the drive comb (FIG. 5*b*), opposing charges build up on both elements which act to draw the drive comb toward the fixed comb, resulting in a powerful linear force on the drive comb 501. The sign of the potential difference does not matter, the force between the fixed comb and the drive comb are always attractive. This device is hence a uni-directional actuator.

Another type of linear actuator which is useful in small-scale devices is the steam-actuated piston shown in FIG. 6. Here barrel 600 defines a bore within which piston 604 is free to slide. The movable components slide on,a supporting surface which is not shown here, and are covered by a cover layer which is not shown. The gap between the diameter of the bore and the largest part of the piston is usually smaller than 10 microns, so that capillary effects will serve to seal the unit against escaping gas. The piston 604 is restricted to linear motion by the action of the barrel and bearings 606, and in the absence of pressure in the barrel (FIG. 6*a*) is held in a neutral position by springs 605. The back end 601 of barrel 600 is penetrated by electrodes 602 (often comprising doped silicon) which allow electrical current to heating element 603. The assembly is such that the overall barrel and piston assembly is sealed against gas escape, and a small amount of volatile fluid (such as water or alcohol) remains within the barrel. When electrical current is passed through electrodes 602 (FIG. 6*b*), heating element heats, and the volatile fluid vaporizes. The resulting vapor pressure drives the piston out of the barrel, providing a uni-directional linear force. When the current is removed, the unit cools, the vapor condenses, and the piston retracts into the barrel under the force of the springs.

The specific MecoCOMP implementations described in detail in the specification and figures use a bi-directional actuator. Although such activators are not necessary for implementation of a MecoCOMP, it is useful to show how they may be constructed from the uni-directional actuators described above.

FIG. 7*a* shows a bi-directional actuator based on the electrostatic comb actuator of FIG. 5. Here there are two fixed combs, 702 and 703, which are electrically insulated from each other and from the drive comb 700. Drive comb 700 has two sets of comb teeth which interdigitate with those of the fixed combs 702 and 703, and is restricted to a linear sliding motion by shaft 701 and bearings 706. In the absence of applied electrical potential, drive comb 700 is held in a neutral position by the action of springs 704. If an electrical potential is applied between the drive comb and fixed comb 702, the drive comb moves to the left, whereas if applied across the drive comb and fixed comb 703, the drive comb moves to the right.

Note that this type of actuator has a potentially useful property. If a potential user only has electrical access to one of the fixed combs, he cannot induce the unit to make other than uni-directional motions. It is possible in principle for the potential user to interfere with the ability of the access control authority to make the actuator move in the opposite direction, but the potential user is restricted to causing motion in one direction only. This suggests that it may be possible to replace the system of separate uni-directional actuator plus bi-directional actuator by some mechanism using only a bi-directional actuator of the type illustrated in FIG. 7. This can be done, and results in simplified designs for the indexing mechanism, to be described later.

A similar bi-directional actuator can be made of the micro-steam piston actuators of FIG. 6, although the way that bi-directional motion is obtained is different owing to the different modes of operation of the underlying uni-directional actuators. In FIG. 7*b* appears an opposing pair of micro-steam piston actuators 710 and 711. Located between them and free to rotate on pin 713 is lever 712, which provides the primary output of the actuator. Lever 712 is normally held in a neutral position through the action of springs 714. When micro-steam piston 710 is actuated, the piston extends from the barrel, and pushes lever 712 to the right. Conversely, when micro-steam piston 711 is activated, the moving piston forces lever 712 to the left. This type of mechanism again provided bi-directional linear motion which can be limited to uni-directional motion by limiting access to the mechanism control impulses.

In the above the nature of the indexing mechanism (e.g., 113 in FIG. 1) has largely been left undefined. FIG. 8 shows a typical form of indexing mechanism, and FIGS. 8 and 9 show its operation through complete cycles of rotating a wheel-like coded element clockwise and then counterclockwise. Many other implementations will be clear to one skilled in the art.

Figure 8A:
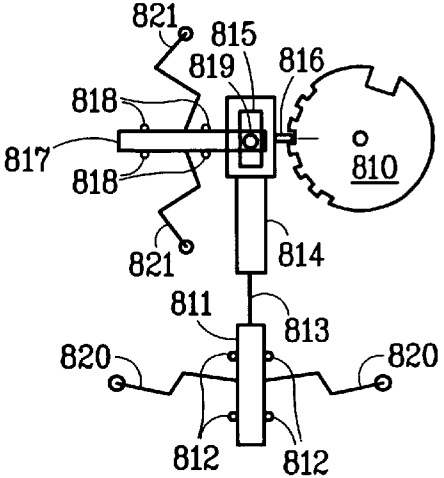
Figure 8B:
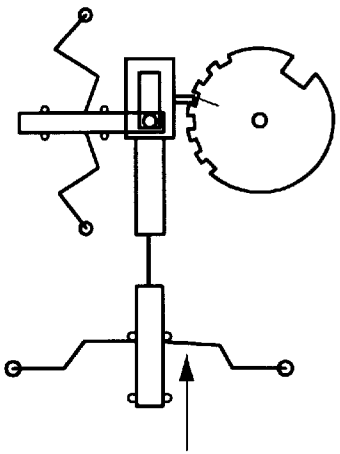

FIG. 8*a* shows the essential features of the indexing mechanism. Coded wheel 810, which comprises index notches and a try bar notch, is positioned on an underlying supporting surface (not shown). In the initial position, indexing pin 816 is in the index notch marked by a dash. The indexing mechanism comprises a vertical drive member 811, which is restricted to linear motion by the action of bearings 812, and in the absence of applied forces (as in FIG. 8*a*) is held at a neutral position by springs 820. When a force is applied to vertical drive member 811 by a bi-directional actuator (not shown), the resulting motion is transmitted through flexible member 813 to vertical indexing cage 814. Vertical indexing cage 814 comprises a pin guidance notch 815 and indexing tab 816, which engages one of the index notches on coded wheel 810 when the mechanism is in the neutral state. Restricted to horizontal movement by bearings 818, indexing shaft 817 comprises guidance pin 819 which protrudes through pin guidance notch 815. The position shown in FIG. 8*a* for the indexing shaft is considered neutral, and is maintained in the absence of applied force by springs 821.

When an upward (relative to the figure) force is applied to the vertical drive member 811, the motion is transformed into a vertical movement of the indexing tab 816, and a corresponding clockwise rotation of the coded wheel 810. The amount of motion that 811 transmits is limited by a physical stop (not shown), so that the rotation of coded wheel 810 is just that required to bring the notch immediately neighboring the index notch marked by the dash. This is the condition indicated in FIG. 8*b*.

Figure 8C:
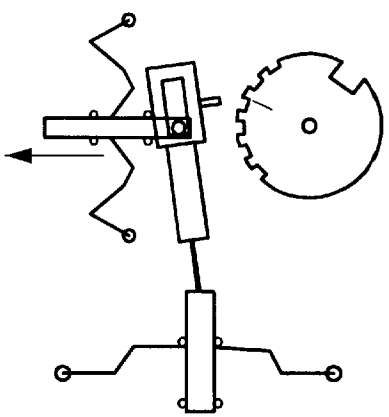
Figure 8D:
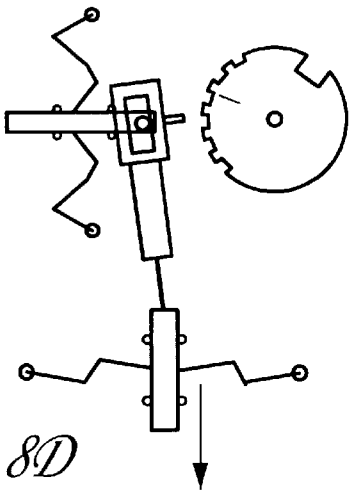
Figure 8E:
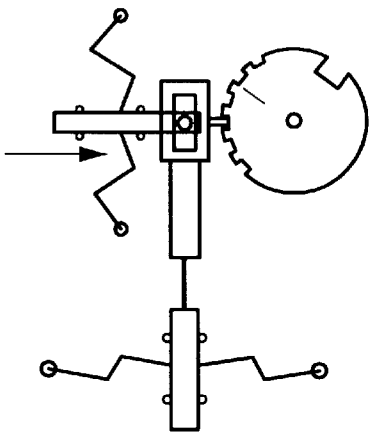

At this point, a leftward force is applied to the indexing shaft 817 by an actuator (not shown). As shown in FIG. 8*c*, this motion carries along the vertical indexing cage 814 by bending flexible member 813. In doing so, indexing tab 816 becomes disengaged from the marked notch of the coded wheel 810. In the next stage of operation (FIG. 8*d*), the force applied to the vertical drive member 811 is removed, causing it to relax back to the neutral position under the action of springs 820. At this point, the force applied to the indexing shaft 817 is removed, and it in turn relaxes back to the neutral position as shown in FIG. 8*e*. The result of the cycle of operation shown in FIG. 8 is that the coded wheel 810 has been turned one notch in a clockwise direction.

The procedure for causing the coded wheel 810 to turn one notch in the opposite direction is illustrated in FIG. 9. In FIG. 9*a* an indexing mechanism is shown in the same configuration as appears in FIG. 8*a*. For clarity the same part numbers are used in the two figures.

The beginning of the counterclockwise cycle is to apply a downward force on vertical drive member 811. This is accomplished by an actuator (not shown). The resulting motion is transformed into a downward motion of the indexing tab 816, and a corresponding counterclockwise rotation of coded wheel 810. The amount of motion that 811 transmits is limited by a physical stop (not shown), so that the rotation of coded wheel 810 is just that required to bring the notch immediately neighboring the index notch marked by the dash. This is the condition indicated in FIG. 9*b*.

Figure 9C:
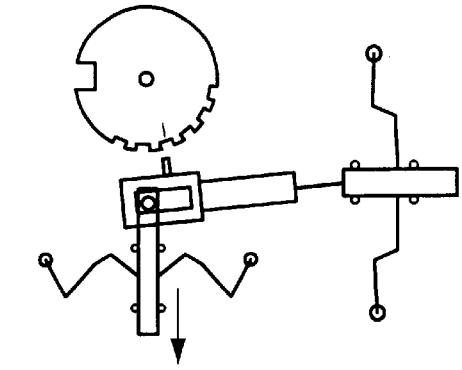
Figure 9B:
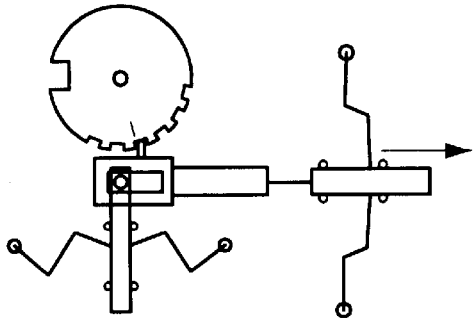
Figure 9A:
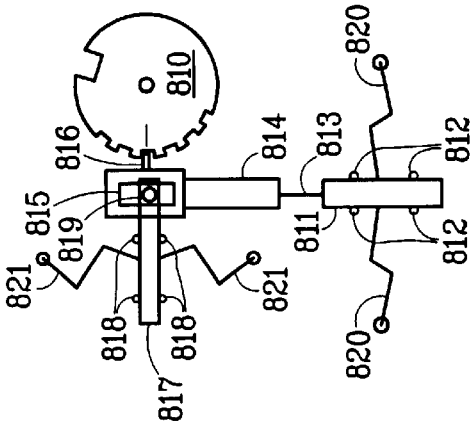
Figure 9E:
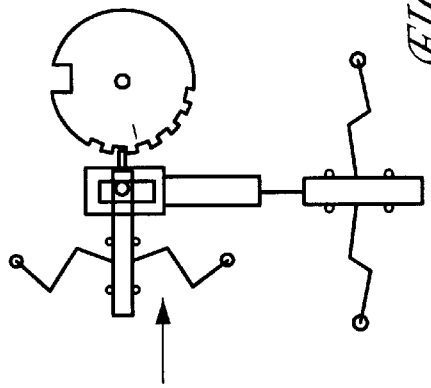
Figure 9D:
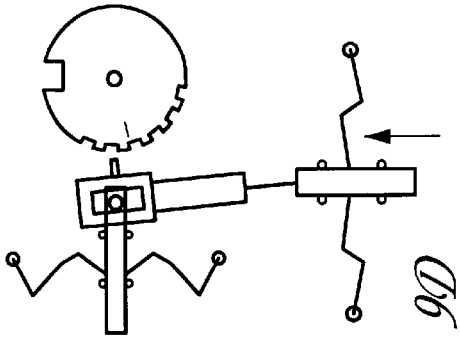

At this point, a leftward force is applied to the indexing shaft 817 by an actuator (not shown). As shown in FIG. 9*c*, this motion carries along the vertical indexing cage 814 by bending flexible member 813. In doing so, indexing tab 816 becomes disengaged from the marked notch of the coded wheel 810. In the next stage of operation (FIG. 9*d*), the force applied to the vertical drive member 811 is removed, causing it to relax back to the neutral position under the action of springs 820. At this point, the force applied to the indexing shaft 817 is removed, and it in turn relaxes back to the neutral position as shown in FIG. 9*e*. The result of the cycle of operation shown in FIG. 9 is that the coded wheel 810 has been turned one notch in a counterclockwise direction.

Figure 10A:
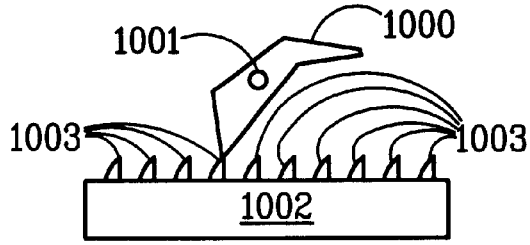

The indexing mechanism described in detail above is not the only approach toward implementing this function. Indeed, a wide range of mechanisms suited for this function will be clear to one skilled in the art. An example of an alternate indexing mechanism appears in FIG. 10. Here we see a unidirectional indexing mechanism acting to move a linear slide 1002 the distance between index teeth 1003 each time it is activated. Pawl 1000 rotates on axle 1001 in response to an external actuator (not shown). In FIG. 10*a* the mechanism appears at the start of the indexing cycle, at which time one of the index teeth 1003 is in contact with a notch in the blunt end of pawl 1000. This prevents unwanted motion of the linear slide 1002.

Figure 10B:
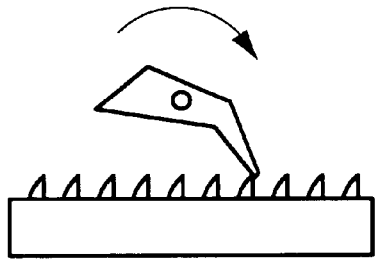
Figure 10C:
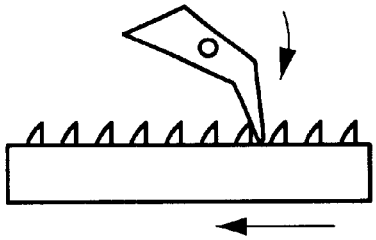
Figure 10D:
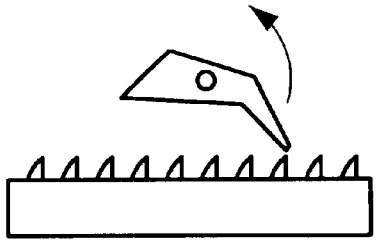
Figure 10E:
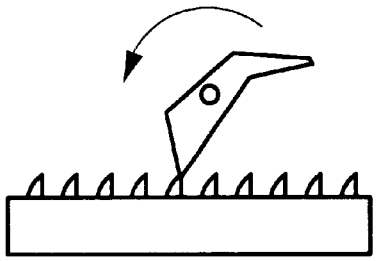

FIG. 10*b* shows the indexing mechanism at the point in its operational cycle where the narrow end of pawl 1000 first touches one of the index teeth 1003. In FIG. 10*c* the rotation of pawl 1000 has continued, until the narrow end of pawl 1000 is in contact with linear slide 1002. Between the states shown in FIGS. 10*b* and 10*c*, the linear slid 1002 moves one tooth spacing to the left, a distance fixed by the detailed shapes of the components, particularly that of the pawl and of the index teeth. These shapes are such that when the pawl rotation is reversed (FIG. 10*d*), the linear slide does not move to the right. At the end of the operational cycle, the notch in the blunt end of pawl 1000 again rests upon one of the index teeth, but now on the tooth to the right of the original tooth.

In the preceding the general principle of operation of the present invention have been outlined, as has the detailed function of some important subsystems. To pull this information together into a coherent pattern, FIGS. 11 through 16 show a four-element MecoCOMP and its operation in detail.

FIG. 11 provides an overview of a MecoCOMP having 4 coded elements in the form of notched disks. Because of the amount of detail in this figure, the important subsystems and features are identified in FIG. 12 in the context of partial enlargements of FIG. 11. FIG. 12*a* shows the coded element 1200, which will appear in more detail in FIG. 12*b*. A unidirectional electrostatic comb shuttle actuator 1201, when activated, moves indexing shaft 1203 from a neutral position established by springs which are part of actuator 1201 to a position in which the indexing tabs (shown earlier) are withdrawn from their engagement with the index notches 1207 and 1208 of the coded element 1200. A bi-directional electrostatic comb indexing actuator 1205 moves vertical indexing cage 1204 up and down relative to a neutral position established by springs which are part of actuator 1205.

A very important feature shown in FIG. 12*a* is the electrical leads (indicated as lines broken periodically with zigzag features) which control the actuators. As described earlier, the control of a MecoCOMP is divided into two physically distinct sets of inputs, one set accessible only from a secure side (i.e., those intended for the sole use of the access control authority) and the remainder which are accessible from both the secure side and an open side, and which may be used by a potential user in an attempt to activate the MecoCOMP. In FIG. 12*a*, the electrical lead which activates unidirectional actuator 1201 and the electrical lead which activates upward movement of bi-directional actuator 1205 (which drives counterclockwise motion of coded element

1200) are accessible from both sides, whereas the electrical lead which activates downward movement of bi-directional actuator 1205 (which drives clockwise motion of coded element 1200) is accessible only from the secure side. This separation and isolation is implemented in hardware, so the security barrier cannot be breached by software attack.

FIG. 12*b* shows the coded element in more detail. The essential structure is a disk 1206 as originally shown in FIG. 1. Disk 1206 contains a code notch 1207 and a number of index notches 1208 distributed along the rim of disk 1206 so that the angular separation between neighboring notches is essentially constant. Proper function of the MecoCOMP requires that the code notch not be the most clockwise or the most counterclockwise notch on disk 1206. Try bar notch 1209 in this design is located at an angle of 90 degrees in a clockwise direction from the code notch 1207. A cylindrical pin guide 1210 is cut from disk 1206. The purpose of pin guide 1210 is to restrict the amount of rotation available to disk 1206 by interference with limit pin 1211 which extends from an underlying structure.

FIG. 12*c* shows the try bar subsystem. Try bar 1212 comprises try bar keys 1213, one for each coded element and having the same spacing as the coded elements. Try bar 1212 also comprises limit pins 1214, whose function is to prevent downward motion of try bar 1212. Cutouts (shown in FIG. 11) in indexing shaft 1203 are positioned so that the limit pins 1214 can move downward only if the indexing tabs (shown earlier) are fully engaged with notches 1207 or 1208 in disk 1206.

Downward motion of try bar 1212 can be driven by unidirectional try bar actuator 1215, control of which is supplied to the user on the open side. A feature which is useful, but not required for MecoCOMP function, is a "one-try" mechanism comprising unidirectional reset actuator 1216 and trigger notches 1217. The slanted rod of unidirectional reset actuator 1216 is initially engaged with trigger notches 1217. When try bar 1212 moves downward, the slanted rod moves to the right against the force of the springs which maintain unidirectional reset actuator 1216 in a neutral position. As the try bar moves farther, the slanted rod ratchets from the original trigger notch into a trigger notch higher up the try bar structure. When this happens, the try bar cannot be withdrawn without activation of unidirectional reset actuator 1216. Access to the electrical lead controlling actuator 1216 is limited to the secure side of the MecoCOMP, and can only be actuated by the access control authority. The "one-try" mechanism, and other mechanisms which serve the same purpose, require an input from the secure side to allow any additional open inputs to the MecoCOMP following an unsuccessful attempt at access.

Returning now to FIG. 11, four coded elements and indexing mechanisms as shown in FIGS. 12*a* and 12*b* are ganged together under the control of a single indexing shaft. The try bar subsystem as shown in FIG. 12*c* is in place, and properly oriented with respect to the coded elements for operation. The MecoCOMP is in a state of clockwise reset—that is, all the coded elements have been rotated in a clockwise manner as far as possible. This is a state which can only be set using secure controls, and is the starting point for entering a security code into the MecoCOMP.

An important point is that the position of the code notch 1207 amongst the index notches 1208 need not be the same for each coded element. In FIG. 11, in the leftmost coded element the code notch is the fourth most clockwise notch. In the second leftmost coded element the code notch is the second most clockwise notch. In the third leftmost coded element the code notch is the third most clockwise notch. Finally, in the rightmost coded element the code notch is the seventh most clockwise notch.

The code notch should usually not be the most clockwise notch, because then that part of the access code could be opened by an attacker simply by moving the coded element to a fully counterclockwise position. If the code notch is always (for example) the second most clockwise notch, the MecoCOMP has the maximum number of combinations. However, if it is known that MecoCOMP devices all have this structure, then a physical assault on the control inputs of the MecoCOMP can lead to immediate access. The unauthorized user then simply uses the open electrical leads to move the coded elements into a fully counterclockwise position, and then the secure electrical leads to move each coded element one notch clockwise. The MecoCOMP will then allow access.

If instead each coded element has the code notch in a different position, then it is necessary to know what might be called the intrinsic code of the MecoCOMP to gain access, even if the security code is somehow compromised. In the present case (FIGS. 11 and 13–16) this intrinsic code is 3126, representing the number of notches clockwise of the coded notch. This becomes clearer as we trace the function of the sample MecoCOMP implementation through a sequence of operations.

FIG. 13 shows the MecoCOMP after a security code (3421) is entered. These are the number of counterclockwise steps applied to the first, second, third, and fourth coded elements (these listed left to right). At this point the MecoCOMP is set and ready to accept an attempted access code. The proper access code is now 4563, again representing the number of counterclockwise steps which must be applied to the coded elements, in order, so that the key bar features will line up and allow access to the asset secured by the MecoCOMP. For these 11-notch coded elements, and given the definitions above for the intrinsic code, the security code, and the access code, the access code for a given coded element will be the quantity (10–[intrinsic code+security code]).

FIG. 14 shows the configuration of the sample MecoCOMP device after an incorrect access code (3826) and after an attempt to access the protected asset, i.e., following activation of the try bar actuator 1215. The try bar 1212 has not moved downward far enough to release the protected asset, but has moved far enough that the limit pins of the try bar are engaged with the cutouts in the indexing shaft, and the "one-try" mechanism has engaged. In this configuration, no further attempts to access the protected asset can be made until the MecoCOMP is reset by a secure-side activation of unidirectional reset actuator 1216. When this is done, the try bar returns to its neutral position, and the MecoCOMP can be reset with a new security code.

FIG. 15 shows the configuration after the proper access code has been entered. The try bar notches of the coded elements are all aligned to accept the try bar keys, so the try bar is free to move downward, as shown in FIG. 16. Here the try bar is in its fully downward position, and is locked there by the "one-try" mechanism. This full motion of the try bar results in the desired access to the protected asset through activation of an access subsystem not yet described in detail.

Having thoroughly described the operation of several specific implementations of the MecoCOMP invention, some attention must be turned to the manner in which motion of the try bar mechanism sets into motion a sequence of events which culminate in allowing the applicant access to the protected asset. One can imagine many techniques whereby the motion of the try bar can be detected, and a signal of some sort derived therefrom to make access possible. Possibilities include detecting the full operation of the try bar actuator (for example, if this actuator is an electrostatic comb drive, then the capacitance of the drive changes dramatically when the comb teeth close together), measuring change in capacitance when a sheet of material moving with the try bar is moved between two electrodes, and many others based on such material properties. Such techniques tend to be complicated, however, and their output is likely to be a digital signal controlling a software program. Although such signals can be used, they are susceptible to software attack, thereby reducing the security of the protected asset by making possible bypassing the MecoCOMP entirely.

The range of mechanical motion of the try bar is large enough (10*s* of microns or more) that this motion can act as a mechanical switch which is the only point of contact between the MecoCOMP and the underlying protection for the assets. By so separating the systems, no combination of inputs to the control circuitry for the MecoCOMP can affect the underlying protection in any but the desired manner, and access to software which may be associated (if only by using the same computer) with that protection is not enabled until this mechanical signal is delivered and triggers an action (e.g., tripping switches) which is not software controlled. In such a manner unauthorized access to a MecoCOMP protected system can be rendered nearly impossible.

FIG. 17 illustrates one implementation of an electro-optical switch activated by the motion of the try bar when the correct access code is entered. Try bar 1700 is attached to try bar actuator 1701, and comprises a "one-try" mechanism 1702. Optical shutter 1703 is attached to the moving part of try bar actuator 1701, and in FIG. 17*a* is shown in the "access denied" position, where it blocks a beam of light (not shown) directed through aperture 1704 in an underlying surface. In FIG. 17*b,* after the correct access code is entered and the try bar actuator has been actuated, optical shutter 1703 has moved far enough that the beam of light is not intercepted, and can pass to a waiting photo-detector (not shown). The signal from the photodetector then enables access to the protected asset.

FIG. 18 retains the idea of using electro-optical switching, but implements it in a very different manner. FIG. 18*a* shows the system in the "access denied" configuration. A try bar actuator 1801 is connected to a drive cage 1802. This drive cage is connected to hinged micromirror 1803 through the action of rotary connectors 1806. The opposite end of hinged micromirror 1803 is similarly connected to hinged plate 1804, the opposite end of which is similarly connected to fixed pivot 1805. As seen in cross-section (FIG. 18*b*), the hinged micromirror 1803 and the hinged plate 1804 are nearly parallel to the underlying surface. A beam of light incident on micromirror 1803 reflects in a manner so that it does not activate a photodetector (not shown). Note that multiple switches can be implemented if plate 1804 is also a micromirror, and still more possibilities appear if additional hinged micromirrors are added to the unit.

FIG. 18*c* shows the micromirror switch after the proper access code has been entered into the associated MecoCOMP device and the try bar driven home. The angle of hinged micromirror 1803 has changed, so that the reflected beam of light now activates the photodetector (not shown), and thereby enables access to the protected asset.

Other forms of electro-optical switches activated by try bar movement can easily be developed, as can purely mechanical switches leading to access control. Mechanically driven electrical switches are quite useful in many applications, and warrant some discussion. In FIG. 19*a* appears such a switch in the "access denied" position. Try bar actuator 1900 is in its neutral position. Attached and free to move with the moving portion of 1900 is switching member 1901. Assume that switching member 1901 is electrically grounded. In this initial position first contact element 1902 is also grounded by contact to 1901, whereas second contact element 1903 is allowed to float.

When the MecoCOMP is accessed properly, the try bar actuator operates, and the configuration of FIG. 19*b* results. Here the first contact element is floating relative to ground, while the second contact element is grounded. This change in electrical connectivity can be used to activate an independent access control system as described previously.

As mentioned repeatedly heretofore, alternate implementations of most of the major features and subsystems of the MecoCOMP invention exist, and are within the scope of the present invention. Several examples of such alternate implementations are illustrated in FIG. 20. This figure again shows a four-element MecoCOMP whose general operating principles are the same as in FIGS. 8–16, but which differ in various details to be described below. It is the set of general operating principles that makes up the heart of the present invention, rather than any specific set of implementations.

The MecoCOMP implementation shown in FIG. 20 has essentially the same indexing mechanism for turning the coded wheels 2001 as does the apparatus shown earlier, and whose operation is detailed in FIGS. 8 and 9. An added feature is the existence, on each coded wheel 2001, of a set of back teeth 2002, and a matching set of index stops 2003 located on the common indexing shaft 2004. In the earlier MecoCOMP implementation, when the common indexing shaft 2004 is moved far enough to the left in the figure that the indexing tabs 2005 are pulled free, the coded wheels are free to turn in response to vibration, external acceleration, and deliberate tampering. In the present implementation, as the indexing tabs pull free from engagement with the coded wheels, the index stops enter engagement with the back teeth 2002 on each coded wheel. The result is that the coded wheels are never free to turn, save in response to actuation of the indexing mechanism. This offers a significant increase in security of operation for a nominal cost in complexity.

Another change in the implementation of FIG. 20 is that the coded wheels 2001 do not have an isolated try bar feature (notch). Instead, the coded wheels have a series of try bar teeth 2006. One of the spaces between the try bar teeth 2006 is much deeper than the others—this is called the try bar notch 2009. The try bar 2007 has a set of try bar probes 2008 positioned so that all of the try probes fit between adjacent try bar teeth in all of the coded wheels when the indexing tabs are engaged with the coded wheels and the mechanism is in its neutral condition. The try bar probes are thin enough and long enough that they can reach the bottom of the spaces between the try bar teeth 2006. Most of these spaces, however, are not very deep. When the try bar probes are pressed into such spaces, the try bar does not move far enough to allow access to the function being controlled by the MecoCOMP. Only when the try bar notch 2009 of all the coded wheels is accessible by the try bar probes can the try bar move far enough to unlock the apparatus.

Note that as drawn here the spring-loaded ratchet pawl 2010 prevents the try bar from being withdrawn following an attempt to unlock the apparatus. As a result, the try bar probes 2008 remain engaged with the try bar teeth. This feature, although not necessary to the basic function of the apparatus, prevents a second attempt to unlock the device unless the ratchet pawl 2010 is retracted, for example as illustrated here by the action of comb drive 2011.

The remaining major feature of an apparatus according to the present invention as illustrated in FIG. 20 is the comparator test plunger 2012. It is possible to determine the state of the apparatus (i.e., did the try bar engage properly) by measuring the characteristics of the various activators (among many other approaches, some of which were described earlier). However, a purely electrical indication of the fact that the proper code was input to the MecoCOMP apparatus might not be considered sufficiently secure against tampering for some applications. For such applications, a device such as the comparator test plunger can be added. Plunger 2012 can be pressed into try bar test notch 2013 only if the try bar probes successfully enter the try bar notches of all the coded wheels, i.e., only if the proper code has been entered into the MecoCOMP and a comparison attempt has been made. At all other times, the plunger hits the side of the try bar after a very short travel. Such devices separate the process of entering codes which will usually be carried out at least partially via electrical inputs controlled by the person requesting access, from the process of testing the code, which can (if desired) be controlled solely by the access control authority.

Practical Considerations

A particularly advantageous medium in which to implement MecoCOMP devices are the silicon-based materials (e.g., crystalline silicon, polycrystalline silicon, amorphous silicon, silicon oxides, silicon nitride, and related compounds) as fabricated using semiconductor lithographic techniques. This combination of material system and fabrication techniques is often referred to as MEMS technology. This technology provides an excellent combination of small sizes, rapid low-power operation, enormous material strength and toughness, and very low manufacturing cost, rendering MEMS MecoCOMP devices suitable for a wide range of applications.

The Applicants have fabricated a prototype MecoCOMP device using MEMS technology. It has six coded elements, taking the form of notched disks. Each coded element has ten index features, one of which is the code index feature for the element, and a key bar feature. The coded elements are ganged together linearly along a surface so that they can share a single indexing shaft, while having individual indexing cages and actuators. The try bar is implemented with a "one-try" mechanism and associated reset mechanism. The dimensions of the device are 4.6 mm by 9.2 mm by 0.6 mm in nominal thickness. These dimensions, although by no means limiting, suggest that MEMS-base MecoCOMP devices may be used in highly portable data security applications, such as smart cards.

There are a range of applications for MecoCOMP devices beyond the direct access control applications which formed the basis for much of the specification. One example is in computer security, to restrict access to portions of the system when an adversarial attack is detected. In this mode, the MecoCOMP controls critical information paths or control elements. While freely allowing information flow during routine operation (e.g., using optical data transmission), when an attack is detected control personnel having the MecoCOMP access codes could activate the units, thereby terminating the controlled information flow. Any of the electro-optical switch functions described previously would work in this manner. The effect is to implement an administratively controlled use denial function which is partially or totally independent of the system software.

Another application is as a safety device. A MecoCOMP device can be used to inhibit the operation of a dangerous apparatus until it has been actuated by a unique access code the must be generated in real-time by a complex software operating system. As the preparation of the apparatus and the surrounding area proceeds, completion of critical tasks provide input to the generation of an access code. Only if the apparatus has been operated properly and is functioning correctly will the correct access code be generated, thereby allowing the use of the apparatus to proceed.

A wide range of potential MecoCOMP devices and the access control systems enabled thereby are consistent with the detailed implementations outlined above. Illustration of the principles of this invention through discussion of specific implementations is not intended to limit the scope of the claims.

What is claimed is:

1. A mechanical code comparator which compares an access code entered from an open side to a security code entered from a secure side, comprising:

a) multiple coded elements, each comprising multiple index features, a coded index feature, and a try bar feature;

b) an indexing mechanism which engages index features on each coded element and aligns them with a neutral position and wherein the indexing mechanism comprises:

a) a unidirectional shuttle actuator;

b) spring means to hold the actuator in a neutral position in the absence of applied force;

c) an indexing shaft functionally connected to the shuttle actuator and comprising a guidance pin;

d) bearing means to restrict the indexing shaft to linear motion;

e) a bi-directional indexing actuator having an output and secure and open control lines;

f) spring means to hold said actuator in a neutral position in the absence of applied force;

g) a flexible member functionally connected to the indexing actuator output; and h) an indexing cage functionally connected to the flexible member, and comprising an indexing tab and a guidance pin notch within which rides the guidance pin;

c) a secure drive for entering the security code via the indexing mechanism;

d) an open drive for entering the access code via the indexing mechanism;

e) a try bar comprising a try bar key for each try bar feature, such that the try bar is only free to move to an unlocked position if the multiple coded elements are positioned so that the try bar keys can fully engage the try bar features; and f) a try bar drive.

2. The mechanical code comparator of claim 1, further comprising one indexing cage for each coded element, wherein each indexing cage comprises a guidance pin notch and an indexing tab, and further wherein the indexing shaft comprises one guidance pin for each coded element, such that the indexing shaft and the indexing cages are functionally connected by the guidance pins riding in the guidance pin notches.

3. The mechanical code comparator of claim 1, wherein the coded elements further comprise a set of back teeth, and the indexing shaft further comprises at least one index stop so positioned as to engage said back teeth when the indexing shaft actuator is activated.

4. The mechanical code comparator of claim 1, wherein the uni-directional shuttle actuator is an electrostatic actuator or a steam-actuated piston.

5. The mechanical code comparator of claim 1, wherein the bi-directional indexing actuator is an electrostatic actuator or a steam-actuated piston.

6. A mechanical code comparator which compares an access code entered from an open side to a security code entered from a secure side, comprising:

a) multiple coded elements, each comprising multiple index features, a coded index feature, and a try bar feature;

b) an indexing mechanism which engages index features on each coded element and aligns them with a neutral position and wherein the indexing mechanism comprises:

a) uni-directional shuttle actuator;

b) spring means to hold the actuator in a neutral position in the absence of applied force;

c) an indexing shaft functionally connected to the shuttle actuator and wherein the indexing shaft comprises a guidance pin notch within which rides a guidance pin;

d) bearing means to restrict the indexing shaft to linear motion;

e) a bi-directional indexing actuator having an output and secure and open control lines;

f) spring means to hold said actuator in a neutral position in the absence of applied force;

g) a flexible member functionally connected to the indexing actuator output; and h) an indexing cage functionally connected to the flexible member and wherein the indexing cage comprises an indexing tab and the guidance pin;

c) a secure drive for entering the security code via the indexing mechanism;

d) an open drive for entering the access code via the indexing mechanism;

e) a try bar comprising a try bar key for each try bar feature, such that the try bar is only free to move to an unlocked position if the multiple coded elements are positioned so that the try bar keys can fully engage the try bar features; and f) a try bar drive.

7. A mechanical code comparator which compares an access code entered from an open side to a security code entered from a secure side, comprising:

a) multiple coded elements, each comprising multiple index features, a coded index feature, and a try bar feature;

b) an indexing mechanism which engages index features on each coded element and aligns them with a neutral position;

c) a secure drive for entering the security code via the indexing mechanism;

d) an open drive for entering the access code via the indexing mechanism;

e) a try bar comprising a try bar key for each try bar feature, such that the try bar is only free to move to an unlocked position if the multiple coded elements are positioned so that the try bar keys can fully engage the try bar features;

f) a try bar drive; and g) a one-try mechanism comprising a member rigidly attached to the try bar, said member comprising a series of slanted notches along the direction of try bar motion, and a spring-loaded plunger engaging said slanted notches and having a shape matching said slanted notches, so that the try bar is free to move only in the direction resulting in engagement of the try bar keys and the try bar features.

8. The mechanical code comparator of claim 7, further comprising a reset mechanism comprising a unidirectional one-try actuator connected to the spring-loaded plunger of the one-try mechanism, so that the plunger can be disengaged from the slanted notches upon activation of the one-try actuator, thereby resetting the one-try mechanism.

* * * * *